US005221149A

United States Patent [19]

Takekoshi et al.

[11] Patent Number: 5,221,149

[45] Date of Patent: Jun. 22, 1993

[54] TYPE PRINTER

[75] Inventors: Taro Takekoshi; Seiya Sato, both of Suwa, Japan

[73] Assignee: Seiko Epson Corporation, Tokyo, Japan

[21] Appl. No.: 566,915

[22] Filed: Aug. 14, 1990

[30] Foreign Application Priority Data

| | | | |
|---|---|---|---|
| Aug. 17, 1989 | [JP] | Japan | 1-211585 |
| Aug. 17, 1989 | [JP] | Japan | 1-211586 |
| Aug. 17, 1989 | [JP] | Japan | 1-211587 |
| Aug. 17, 1989 | [JP] | Japan | 1-211588 |

[51] Int. Cl.[5] ..... B41J 1/08

[52] U.S. Cl. ..... 400/145.2; 400/187; 400/157.2; 400/156.2; 400/568

[58] Field of Search .... 101/93.09, 93.18, 93.21-93.23, 101/93.26; 400/145-145.2, 146, 152, 157.2, 185-187, 216.1, 365, 370, 371, 372, 378, 156.2, 156.3, 568

[56] References Cited

U.S. PATENT DOCUMENTS

| | | | |
|---|---|---|---|
| 3,169,473 | 2/1965 | Irwin et al. | 101/93 |
| 3,858,287 | 1/1975 | Christoffersen | 101/155 |
| 3,890,894 | 6/1975 | Nihira | 101/93.18 |
| 4,632,581 | 12/1986 | Ito et al. | 400/145.2 |
| 4,723,855 | 2/1988 | Mikoshiba et al. | 400/154.5 |
| 4,741,268 | 5/1988 | Hori | 101/93.28 |
| 4,856,922 | 8/1989 | Berruti | 400/145.2 |

FOREIGN PATENT DOCUMENTS

| | | |
|---|---|---|
| 0276966 | 3/1988 | European Pat. Off. . |
| 57-181883 | 11/1982 | Japan . |
| 1591188 | 6/1981 | United Kingdom . |

*Primary Examiner*—Edgar S. Burr
*Assistant Examiner*—Christopher A. Bennett
*Attorney, Agent, or Firm*—Blum Kaplan

[57] ABSTRACT

A type printer has at least two colors of ink applied alternately in a column direction and is shifted in the column direction for each rotation of the type drum. The type drum is automatically halted once the drum has completed two revolutions. A selection and stop release mechanism control rotation of the type drum, perform type selection and release an automatic stop state of the type drum at the beginning of each print line. A trigger mechanism is synchronized with a pulse generated by a detection mechanism and corresponds to the type position on the type drum. A damper mechanism substantially avoids vibration or rotational fluctuations in the type drum.

92 Claims, 24 Drawing Sheets

TYPE PRINTER

BACKGROUND OF THE INVENTION

This invention relates to type printers typically used in calculators, cash registers, and the like, and more particularly to type printers for high speed and two-color printing.

As compared to printers of the serial type, printers having a type drum are generally employed for high speed printing by simultaneous printing of multiple columns within the same row of type. Market demand for multicolor, high speed printing has significantly grown in recent years.

Type drum printers, such as disclosed in Japanese Laid-Open Patent Publication No. 61-164865 and shown in FIG. 22, print one line at a time by rotating the print drum through one revolution. A type drum 3 in such printers is restricted from moving in the column direction and is driven by a step motor 60. The printer is equipped with a reset pulse detector 62 for detecting a reference phase of step motor 60. A type sheet 4 is wrapped around the type drum. The printer is supported by a frame 1 and includes an ink roller 61 for depositing ink onto type sheet 4. The recording medium is fed along a platen 22. The rotary force generated by step motor 60 is coupled to paper feed gear 23 for advancing the recording medium along platen 22.

Another conventional type drum printer, such as disclosed in Japanese Laid-Open Patent Publication No. 57-181883, obtains a timing pulse from a detector which is responsive to rotation of a type group (e.g., type drum). The type drum of the printer is driven and stopped by application of a force thereto.

Demand has recently increased for smaller, more compact type drum printers. Generally, the motor in the type drum printer is located outside the type drum as disclosed in Japanese Patent Publication No. 57-181883.

There are several drawbacks associated with conventional type drum printers. For example, the type on the type drum is limited to their respective column positions in printing along a given print line of the recording medium. Only one color of ink can be applied to the type on the type drum. Multicolor printing at any desired column is theoretically impossible. A reset pulse detector is required for detecting the reference phase of the step motor. The step motor is expensive. Complicated speed adjustment is required to achieve high speed printing. Many different demands are made on the control circuitry of the printer. The inefficiency of the step motor results in high current consumption. The complicated speed adjustments, demands made on the control circuitry, and inefficient step motors lead to expensive drive circuits.

During type selection, rotation of the type drum and operation of a detection mechanism are halted. The detection mechanism generates timing pulses used by the type drum for rotation of the latter. Consequently, the hammer drive during the printing process (i.e., powering of print electromagnet) cannot be performed in synchronism with these timing pulses. Timing for powering of the print electromagnet must be based on a reference clock signal rather than these timing pulses and is generated by the control circuitry and software. An increased load on the control circuit results. The reference clock frequency also must be highly accurate to ensure a stable energization of the print electromagnet. An increase in associated circuit costs results.

Vibration or rotational fluctuation is also typically encountered in conventional type drum printers when the type drum is stopped and started. Vibration of the type during printing results which degrades the print quality. Rotational fluctuations immediately after driving the type drum can cause incorrect next type selection. The vibrational and rotational fluctuations are aggravated at high printing speeds. The speed at which printing occurs while maintaining acceptable print quality is therefore undesirably limited.

The size of the type drum printer is also limited by the room required within the printer housing to accommodate the type drum and motor and the selection mechanism which is separately positioned within the printer. Furthermore, noise generated by the motor is not muffled by the type drum since the motor is positioned outside the type drum.

It is therefore desirable to provide a compact, relatively quiet, low power, high speed type drum printer which can be built and operated at low cost. Use of a step motor, reset pulse detector and other expensive parts should be avoided.

SUMMARY OF THE INVENTION

Generally speaking, in accordance with the invention, a type printer includes a rotatable type drum having a predetermined operating position prior to initial rotation thereof and a drum gear coupled to the type drum for applying a rotary driving force to the latter. A disabling mechanism for removing application of the driving force to the type drum is applied following two complete revolutions of the type drum. The two revolutions begin at the predetermined operating position. The disabling mechanism is rendered inoperable until these two revolutions have been completed.

During each of these two revolutions, the type drum is shifted slightly to the left or to the right. An ink roller having alternating sections of two different colors (e.g., red and black) is positioned along side the type drum. Accordingly, by shifting the drum slightly to the left or slightly to the right either one or both colors of ink can be applied to the recording medium prior to application of the driving force being removed from the type drum.

The disabling mechanism disables the driving gear when the type drum is at the predetermined operating position. The driving gear includes a notched gear having a plurality of teeth except within the notch. The disabling mechanism includes one or more teeth for insertion into or removal from this notch.

The type printer also includes a projection protruding from a frame. The rotatable drum includes a pair of grooves encircling the rotatable drum and crossing over one another. The projection is positioned within one of the grooves at any moment in time. The projection and grooves serve as a shifting mechanism wherein the rotatable drum upon application of the rotary driving force thereto moves in one of two linear reciprocating directions based on the position of the projection within the grooves.

A controlling device includes a selecting lever, sun-and-planet gear mechanism and a gear including teeth facing radially inwardly and including a pair of cams. The selecting lever is coupled to both the sun-and-planet gear mechanism and one of the pair of cams. The type printer also includes a trigger mechanism which is coupled to the selecting lever for controlling the position of the selecting lever. Based on the position of the selecting lever, the one or more teeth will be within or outside the notch.

A detecting device generates timing pulses, each timing pulse corresponding to one of the positions of type on the type drum. The trigger mechanism is responsive to these timing pulses for initiating movement of the selecting lever.

A damping mechanism suppresses vibration of the type drum created by the driving force being applied to or removed from the type drum. The damping mechanism includes an inertia wheel and a spring which is pressure welded to the inertia wheel.

The type printer also includes a print electromagnet and a plurality of hammers which are housed within the rotatable type drum. The plurality of hammers are driven by the print electromagnet for striking the type from inside the type drum.

The type drum printer therefore provides at least two colors of ink applied alternately based on the position of the type drum. The type drum printer provides a compact, low powered, high speed printing device which avoids use of a step motor, reset pulse detector and other expensive elements. The printer can be manufactured at a relatively low cost. An extremely simple control mechanism is employed.

Accordingly, it is an object of the invention to provide an improved type printer which can be built and operated at low cost.

It is another object of the invention to provide an improved type printer which employs an extremely simple method for controlling operation of the printer having low cost drive circuitry so that low cost control circuits and software are available.

It is a further object of the invention to provide an improved type printer which is relatively fast, highly reliable and suppresses vibrational or rotational fluctuations in the type drum.

It is yet another object of the invention to provide an improved type printer having high print quality which avoids degradation due to vibrational and rotational fluctuations of the type drum during printing and incorrect next type selection due to rotational fluctuations immediately after driving the type drum.

Still other objects and advantages of the invention will, in part, be obvious and will, in part, be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIGS. 16(*b*) and 16(*c*) are elevational and plan views of the trigger mechanism, respectively;

FIG. 16(*d*) and 16(*e*) are elevational and plan views of a trigger attraction plate, respectively;

DETAILED DESCRIPTION OF THE PREFERRED EMBODIMENT

In accordance with the invention, the type drum printer, to which at least two colors of ink are applied alternately in the column direction, is alternately shifted in the column direction for each rotation of the drum. The type drum is automatically halted once the drum has completed two full revolutions. The selection and stop release mechanism control rotation of the type drum, performs type selection, and releases the automatic stop state of the type drum at the beginning of each print line. The selection mechanism is controlled by a trigger mechanism synchronized with a pulse generated by a detection mechanism and corresponding to the type position on the type drum.

The type drum printer is powered by compact DC motor which serves as the drive source. The timing pulse is generated by the detection mechanism when the type drum is stationary (i.e., stopped). The hammers are driven during the printing process, (i.e., powering of the print electromagnet) in synchronism with the timing pulse. The timing pulse is also used to count the type position and determine the timing for driving the selection mechanism during rotation of the type drum.

A damper wheel based on inertia continuously rotates at a constant speed. Occurrence of vibration or rotational fluctuation in the type drum results in an angular velocity difference between the type drum and damper wheel. The angular velocity difference generates frictional torque on the contact surface between the damper spring and damper wheel. Suppression of vibrational or rotational fluctuation in the type drum results.

In accordance with the invention, a compact type drum printer is provided by utilizing the otherwise wasted space within the type drum or drum gear for housing of the motor. One end of the yoke of the print electromagnet passes through the space between the inside of the type drum or the drum gear and the outside of the motor for securing the print electromagnet to the printer body. The rotational noise generated by the motor is also muffled (i.e., blocked) by the type drum or the drum gear.

Figure 6:
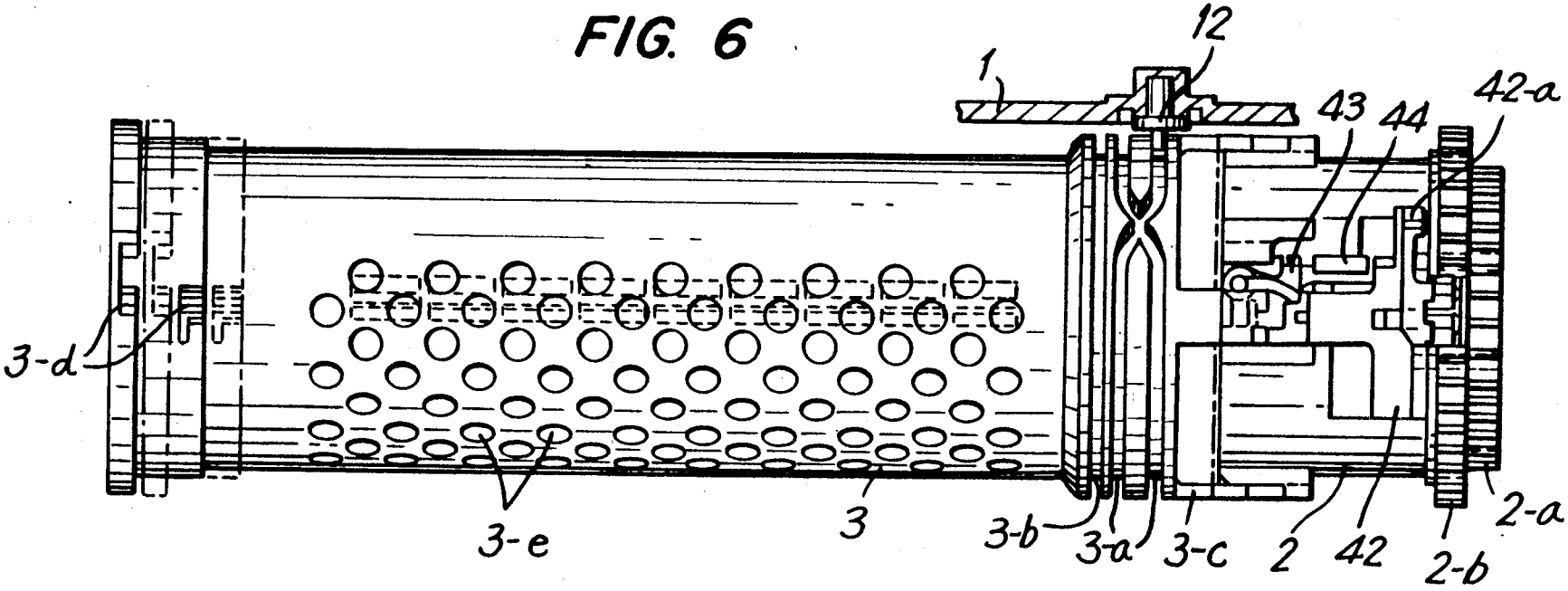
FIG. 6 is a top plan view, in cross section, of the type drum.

Referring now to FIGS. 1–5, a type drum 100 includes a frame 1 having a hole 1-a, a groove 1-b and a stopper 1-c. A drum gear 2 has a ratchet 2*a* (see FIG. 6), a notched gear 2-b, (see FIG. 6), four key grooves 2-c and a shaft 2-d. Each of the four key grooves 2-c is positioned about shaft 2-d, adjacent key grooves 2-c being spaced approximately 90° apart from each other. Drum gear 2 is supported by a bearing 13 (No. 1) and four keys 3-c of a type drum 3. Keys 3-c are slidably received by corresponding key grooves 2-c and are positioned about the circumference of type drum 3. Drum gear 2 and type drum 3 rotate in phase with one another through the interlock arrangement between key grooves 2-c and keys 3-c. Type drum 3 also includes within a single integral unit a cam groove 3-a, a groove 3-b (see FIG. 6), a paper feed drive gear 3-d and a plurality of through-holes 3-e positioned about the outer circumference of type drum 3. Cam groove 3-a has a pair of groves which cross over each other as shown in FIG. 6.

A bearing 14 (No. 2) and an intermediate bearing 48 support type drum 3. A type sheet 4 has a type 4-a arranged in a staggered pattern on its outer surface and a corresponding plurality of protrusions 4-b on its inner surface. A plurality of protrusions 4-c positioned at either end of type sheet 4 and extending in the circumferential direction of type drum 3 are inserted into through-holes 3-e with type sheet 4 wrapped around type drum 3.

Figure 2:
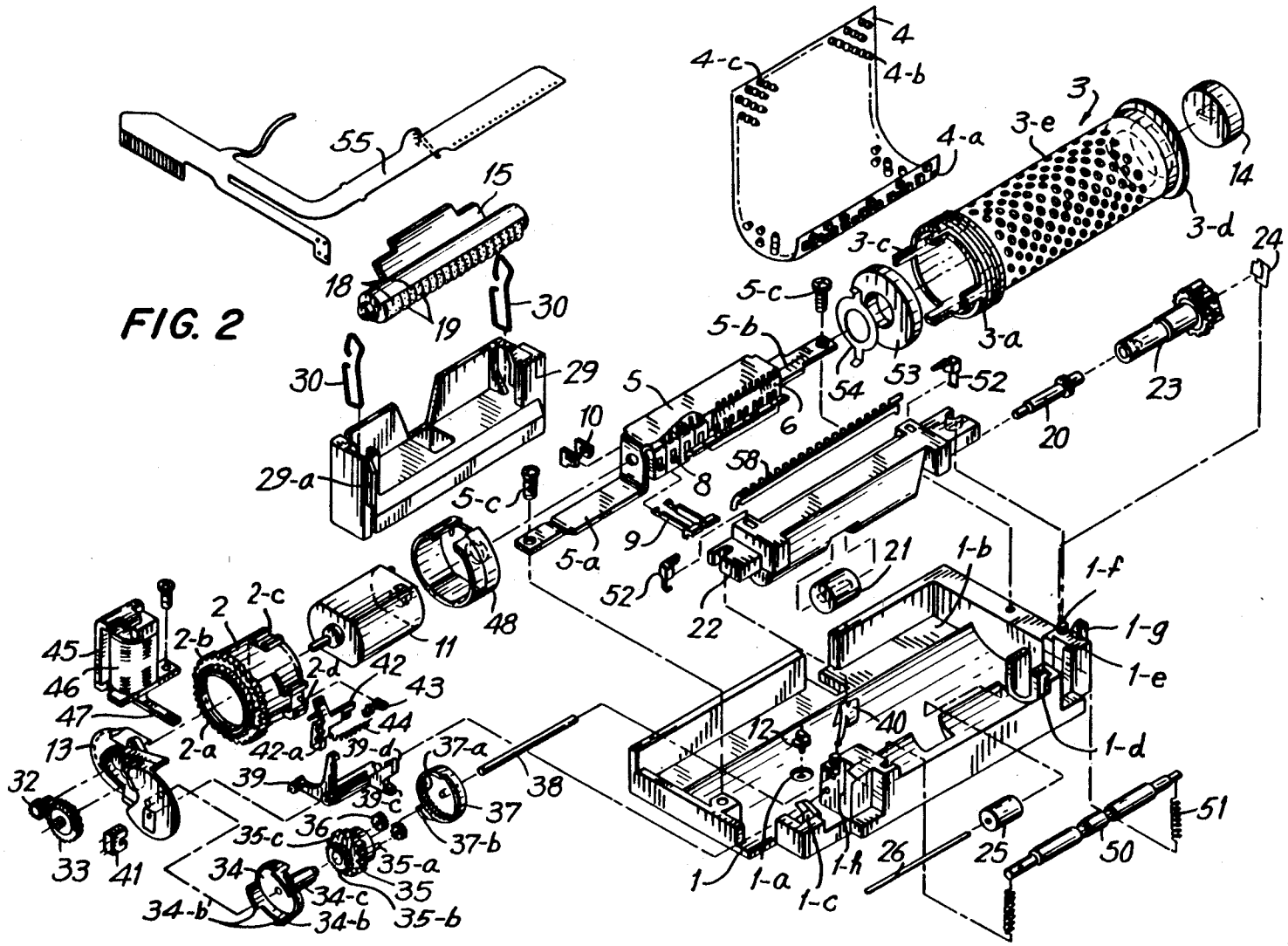
FIG. 2 is an exploded view of the type drum printer of FIG. 1.
Figure 4:
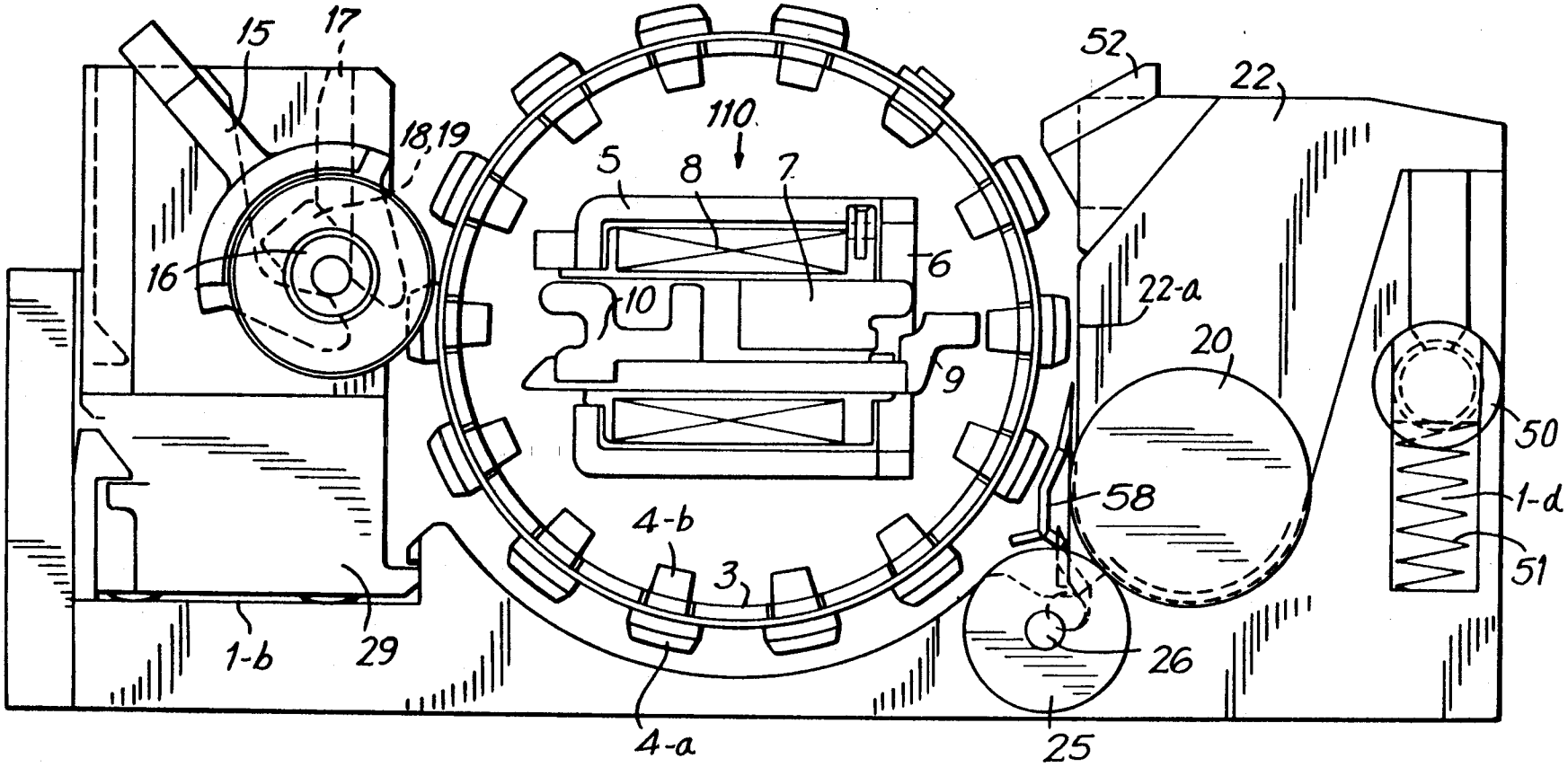
FIG. 4 is a side elevational view, in cross section, of the print mechanism.
Figure 5:
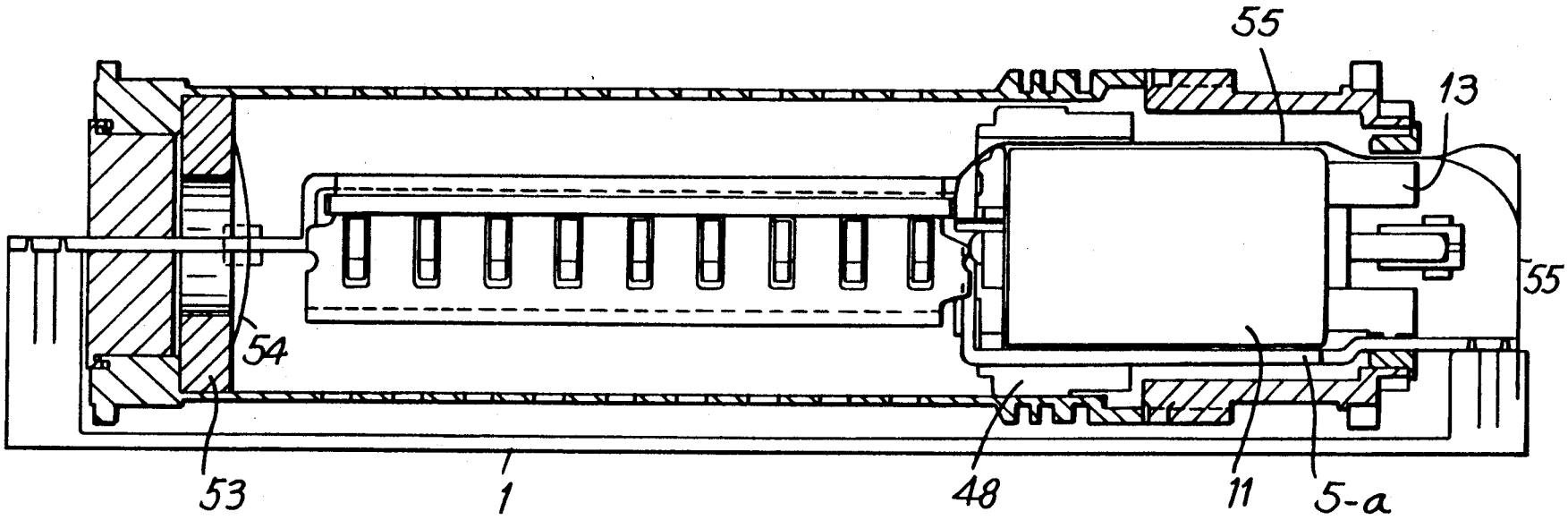
FIG. 5 is rear elevational view, in cross section, within the type drum.

As shown in FIG. 4, a pair of print yokes 5 and 6 serve as the yokes of a print electromagnet 110. A print core 7 is fixed to print yoke 6. Each of a plurality of print coils 8 (also see FIG. 19) is associated with two columns of type 4-a. A plurality of hammers 9 are set inside print coils 8 and are slidable in linear reciprocating directions. As shown in FIG. 2, a plurality of print attraction plates 10 are also positioned inside print coils 8 and move substantially together as a unit with hammers 9 so as to be pulled toward core 7 by the magnetic attraction (i.e., pulling force) of print coils 8 when the latter are energized.

An end 5-a of print yoke 5, shown in FIG. 3, passes below DC motor 11 and through bearing 13 and another end 5-b of print yoke 5 passes through bearing 14 (No. 2). Both ends 5-a and 5-b are secured to frame 1 by a pair of screws 5-c.

Drum gear 2 and bearings 13 and 14 cannot move in the column direction. Type drum 3, however, can shift by a predetermined amount in the column direction. As used herein "column direction" refers to the direction of columns of type 4-a, the column direction being substantially perpendicular to the major axis of type drum 3. As also used herein "lower place columns" and "upper place columns" refer to those columns of type drum 3 near the left end and right end of type drum 3 as viewed in FIG. 1, respectively.

Figure 3:
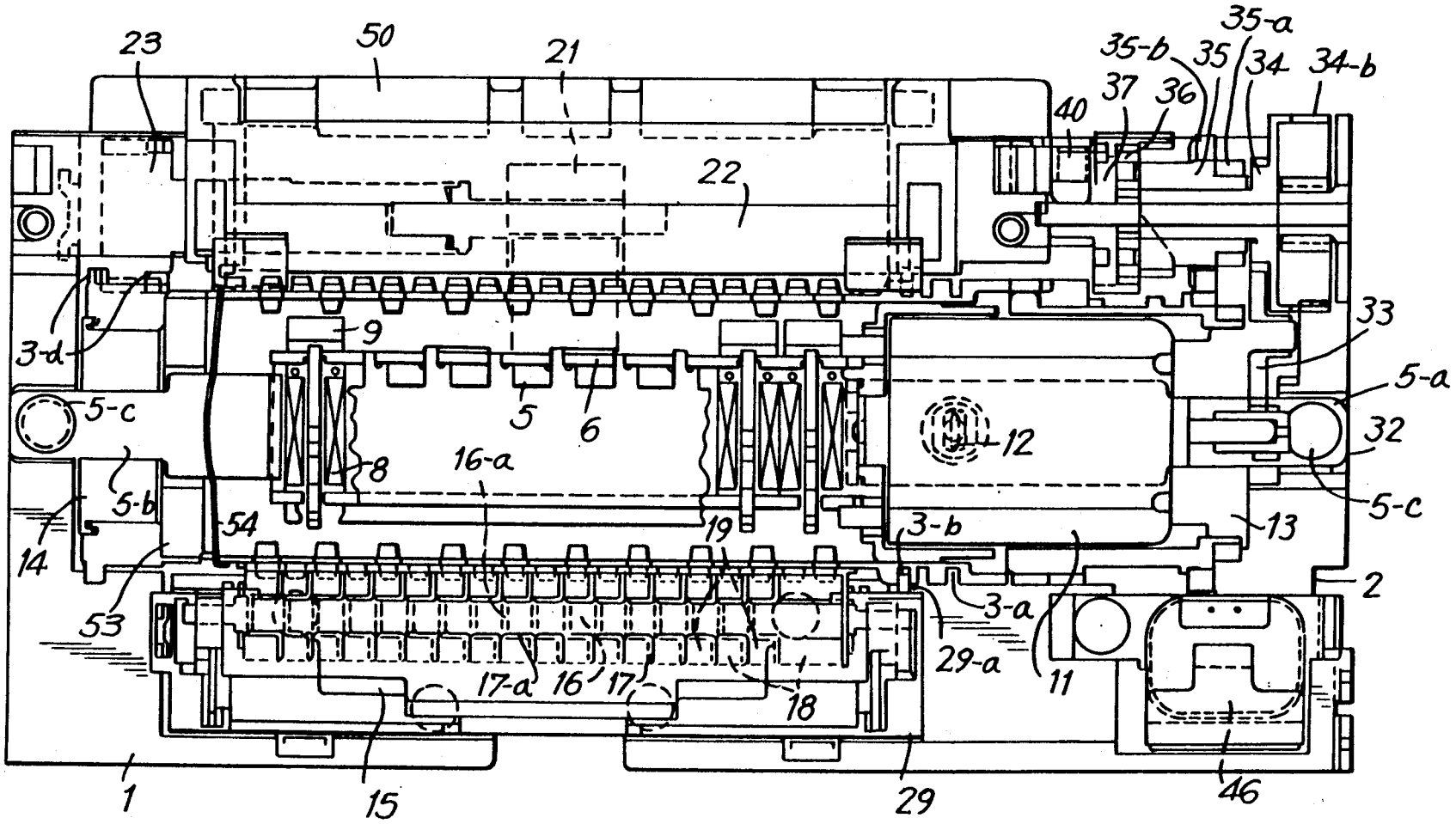
FIG. 3 is a top plan view, in cross section, of the type drum printer of FIG. 1.

As shown in FIG. 3 a compact DC motor 11, approximately 20 mm in diameter, is mounted inside drum gear 2 with a gap therebetween. Drum gear 2 rotates on bearing 13. DC motor 11 is secured within drum gear 2 and is prevented from rotating by bearing 13 and intermediate bearing 48. Motor 11 is distinguished by its flat top and bottom surfaces (commonly referred to as a "double D cut").

Figure 17B:
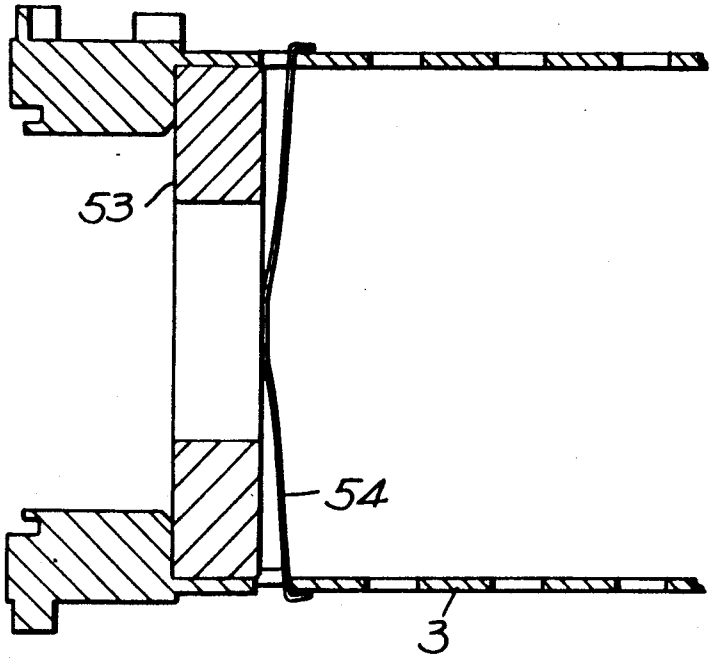
FIGS. 17(*a*) and 17(*b*) are side elevational and top plan views of a damping mechanism, respectively.
Figure 17A:
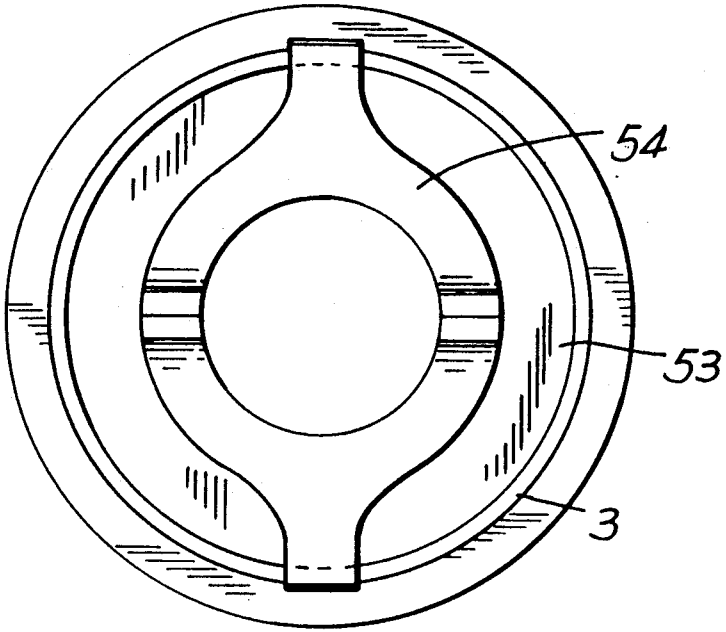

Within type drum 3, as shown in FIGS. 17(*a*) and 17(*b*), a damper wheel 53 is biased towards upper place columns by a damper spring 54. Damper wheel 53 and damper spring 54 form a damping mechanism for suppressing rotational fluctuation in type drum 3.

Figure 1:
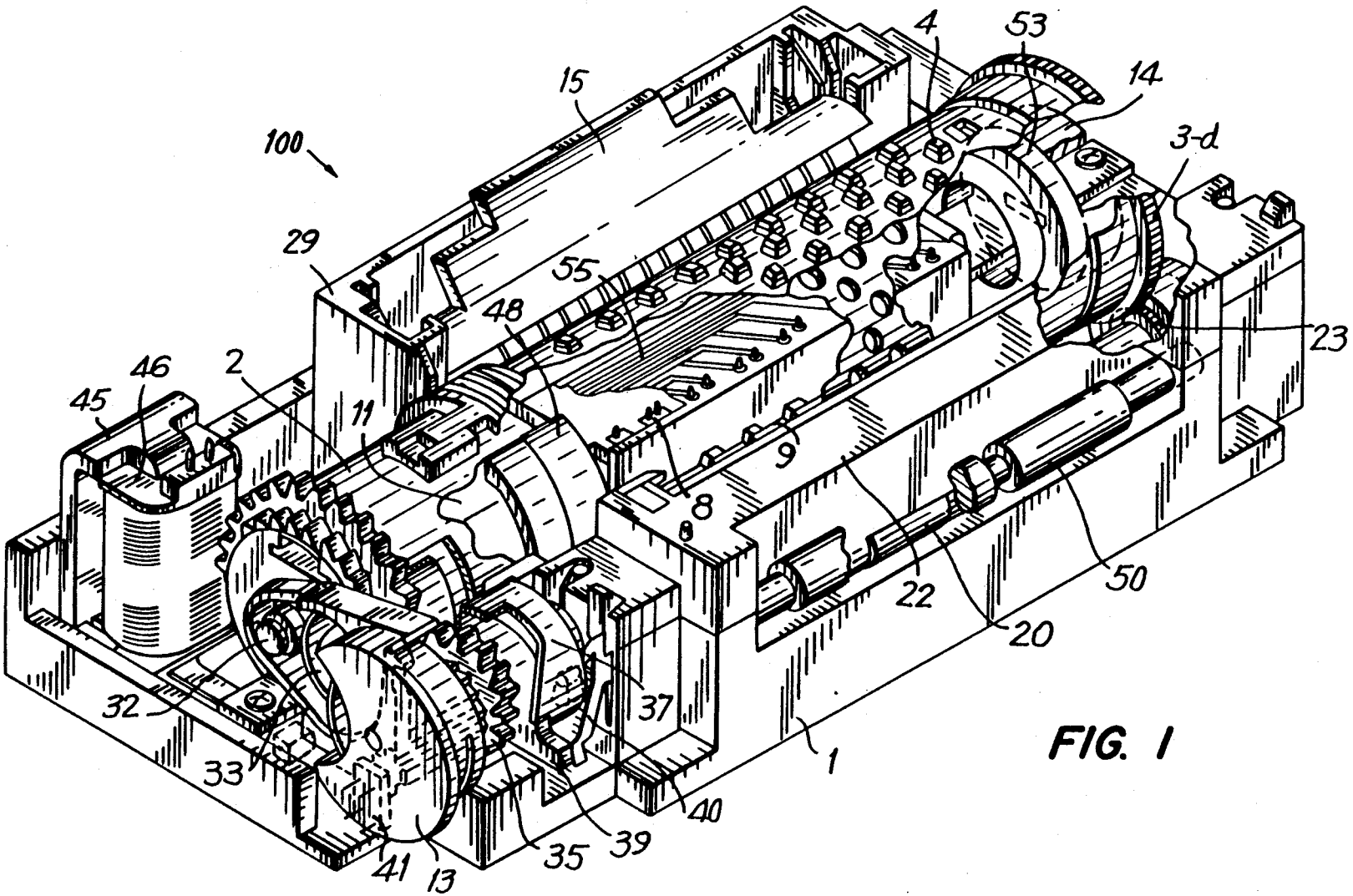
FIG. 1 is a perspective view of a type drum printer constructed in accordance with the present invention.

As shown in FIGS. 1 and 6, a rotor 12 includes a shift mechanism which pivots in hole 1-a of frame 1 and fits in cam groove 3-a of type drum 3 to shift type drum 3 by one column in the column direction for each revolution of type drum 3. An ink roller cover 15, as shown in FIGS. 3 and 4, is supported by an ink roller shaft 16. An ink roller holder 17 holds alternating black ink rollers 18 and red ink rollers 19 and slides freely on ink roller shaft 16. A positioning part 17-a of ink roller holder 17 fits in a groove 16-a of ink roller shaft 16 for shifting ink rollers 18 and 19 in a column direction.

Figure 13:
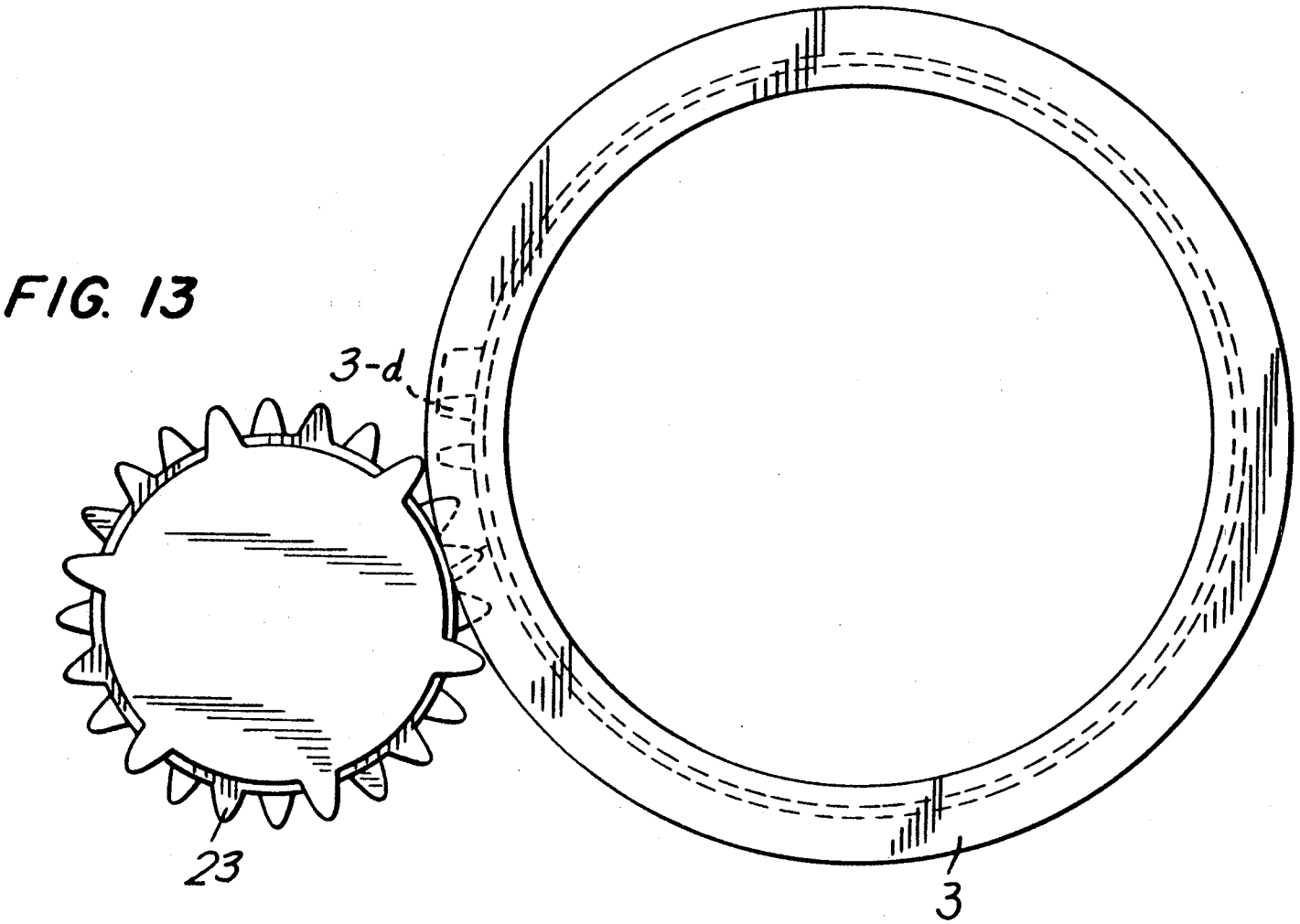
FIG. 13 is a side elevational view of the paper feed gear and surrounding parts.
Figure 14:
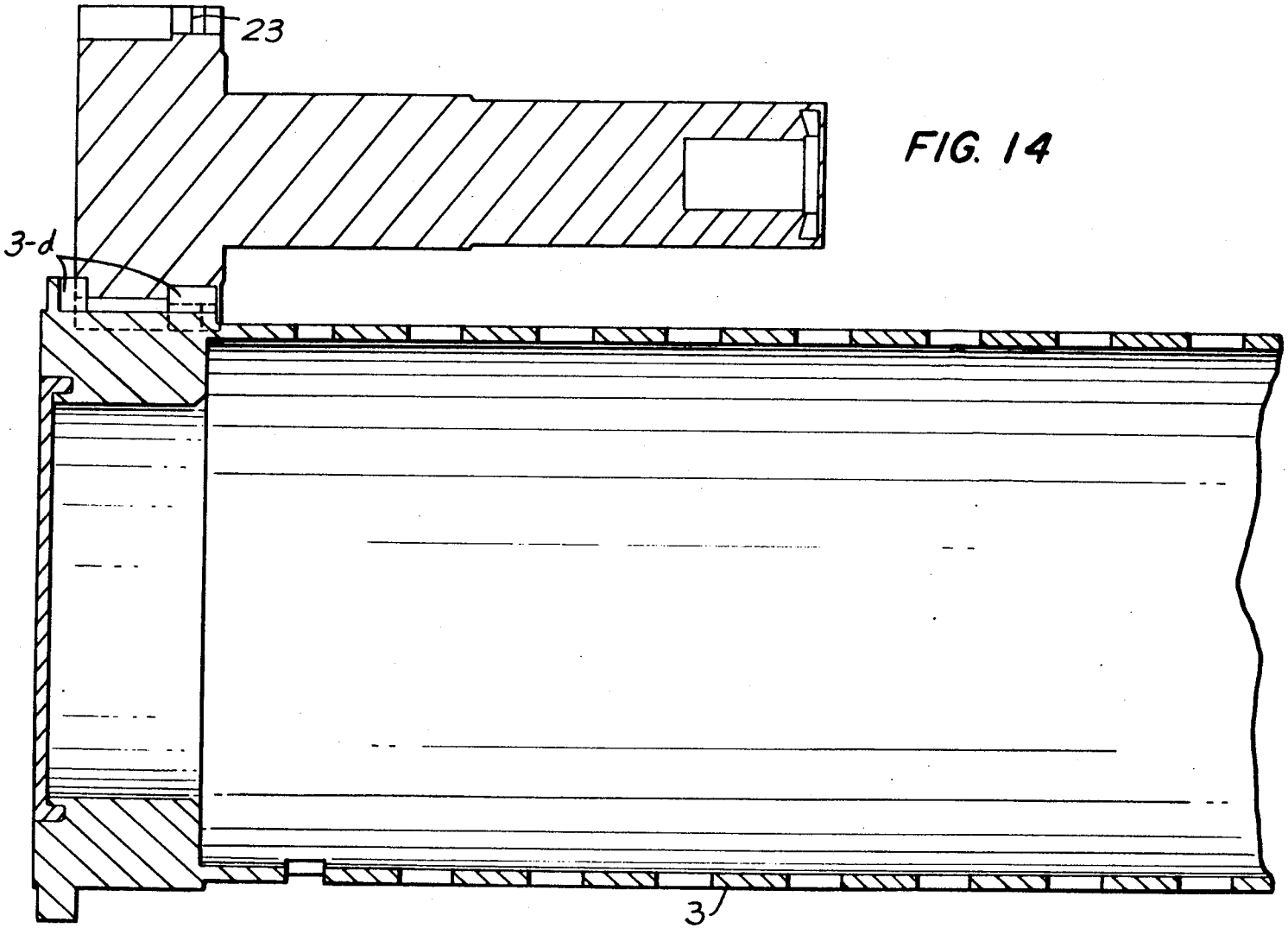
FIG. 14 is a top plan view of the paper feed gear and surrounding parts.
Figure 15:
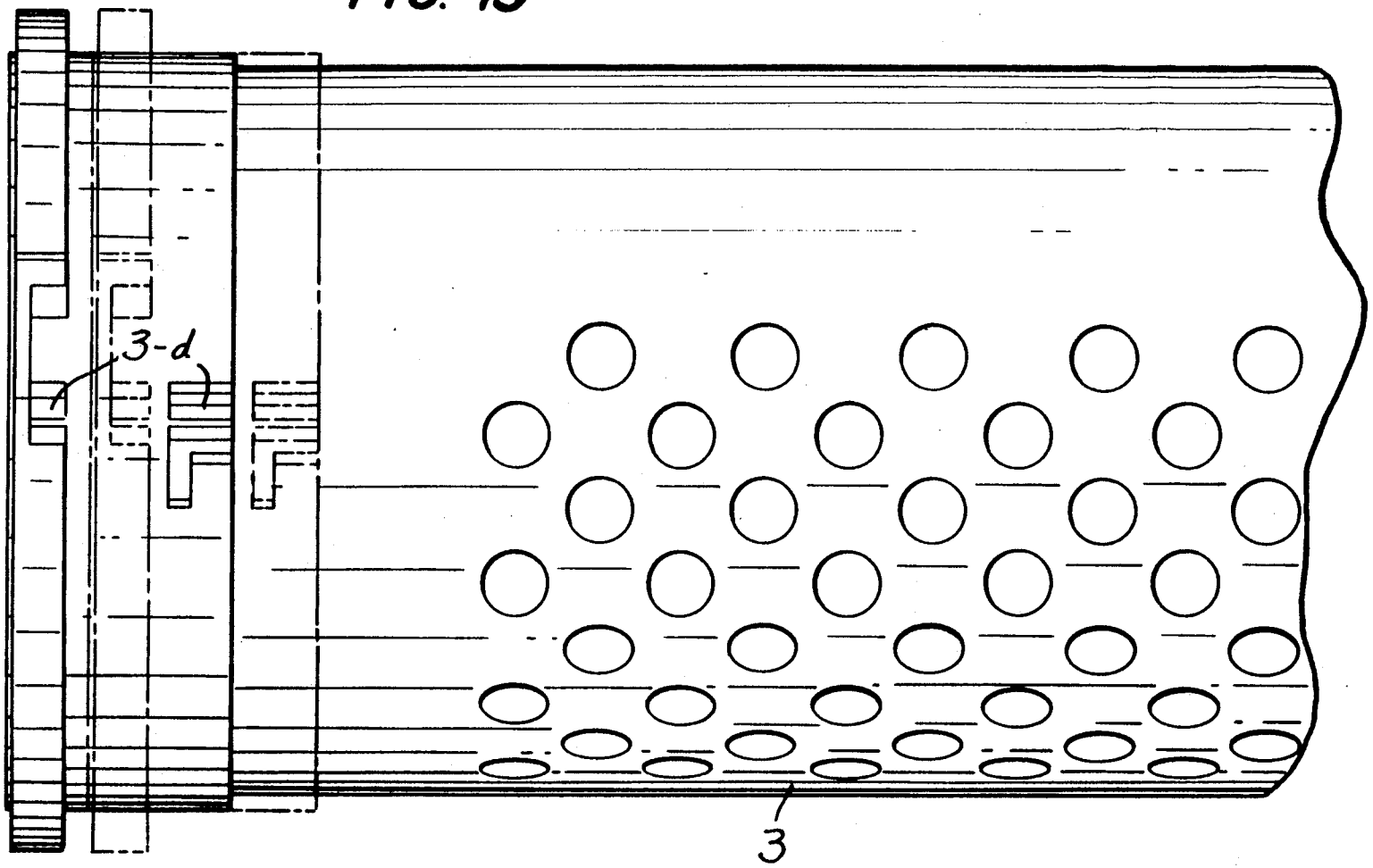
FIG. 15 is an elevational view of the paper feed drive gear.
Figure 16A:
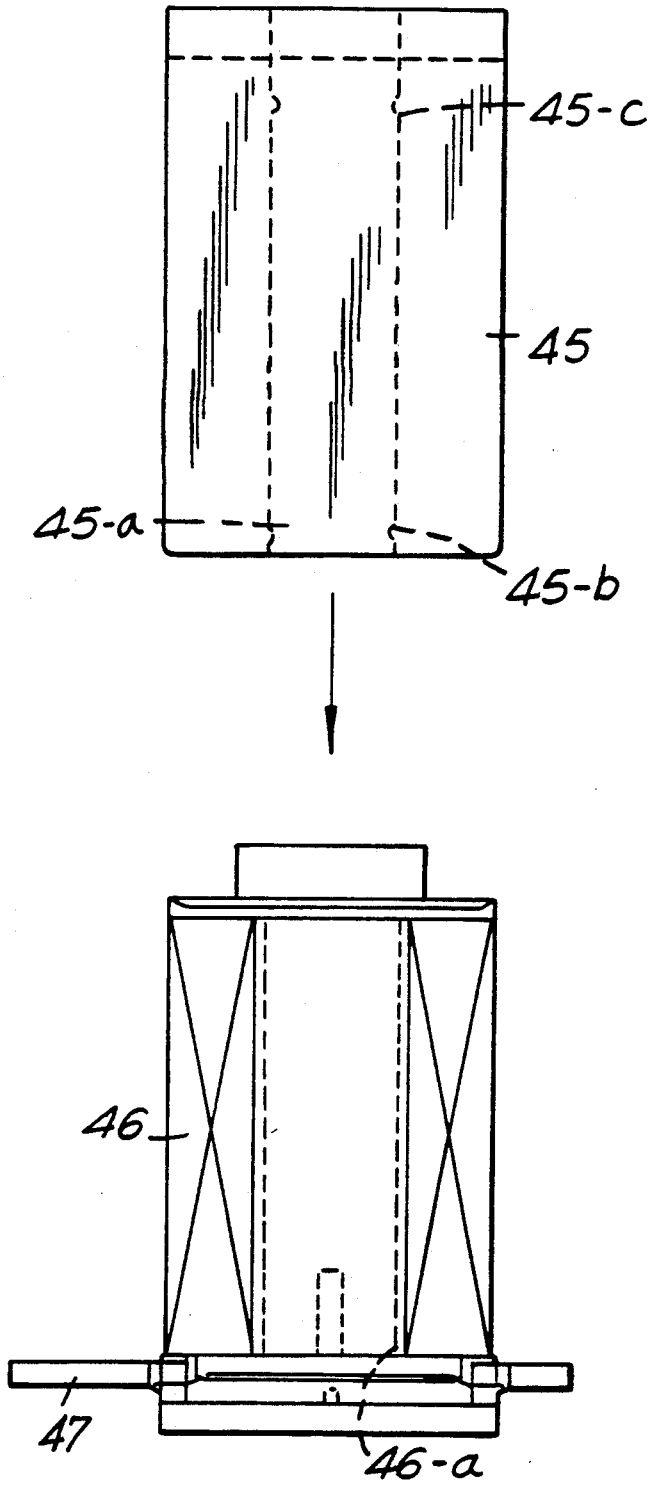
FIG. 16(*a*) is an exploded elevational view of the trigger mechanism.
Figure 16C:
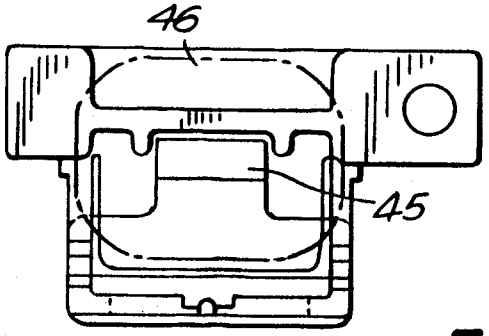
Figure 16E:
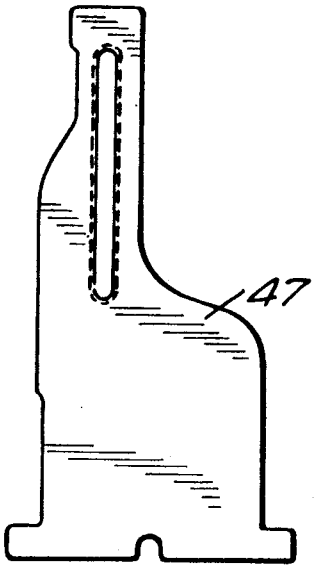
Figure 16B:
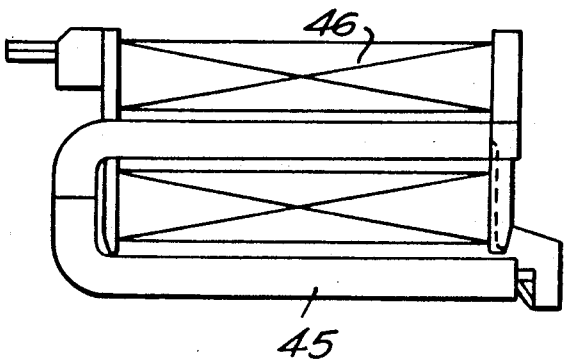
Figure 16D:
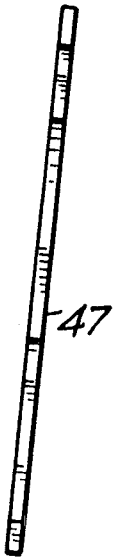

Referring once again to FIG. 2, a paper feed shaft 20 passes through a paper feed roller 21 and is supported by a platen 22 which is attached to frame 1. Platen 22 is positioned from front to rear and from left to right by a pin 1-f on the frame 1 and is secured in a vertical direction by a snap hook 1-g. A paper feed gear 23 is biased towards paper feed shaft 20 by a paper feed spring 24. The secured end of paper feed spring 24 is press fit into a groove 1-e located at the top of frame 1. Paper feed gear 23 and the paper feed shaft 20 are joined together to make up a one-way clutch. To prevent paper feed shaft 20 from slipping within paper feed gear 23, paper feed gear 23 has triangular teeth which mate with corresponding surfaces on paper feed shaft 20. Paper feed gear 23 is therefore securely driven by paper feed shaft 20 when rotating in the paper feed direction. As shown in FIGS. 13–15, paper feed gear 23 is a three-stage intermittent gear which intermittently meshes with paper feed drive gear 3-d of type drum 3 each time type drum 3 shifts following two complete revolutions.

A paper presser shaft 26, as shown in FIGS. 2 and 4, is supported at either end by frame 1 and is inserted in a paper presser roller 25 which presses the recording medium (i.e. paper) to be printed on (not shown) against paper feed roller 21 by the spring force of paper presser shaft 26.

A cushion roller 50 and a cushion spring 51 form a cushion mechanism for reducing (i.e., cushioning) the impact on the paper during the paper feed process. Cushion roller 50 can move up and down in groove 1-d of frame 1 but is normally biased upwardly by cushion spring 51.

As shown in FIG. 4, a paper exit holder 52 regulates the direction of travel of the printed paper at the paper exit position. A paper exit presser 58 presses the paper to be printed against a printing surface 22-a of platen 22 just before the line on which the paper is to be printed on reaches the printing position. Both paper exit holder 52 and paper exit presser 58 are secured by snap fits to platen 22.

Referring to FIGS. 2 and 3, an interlock frame 29 and type drum 3 shift as one unit along groove 1-b of frame 1 based on protrusion 29-a being seated within groove 3-b of type drum 3. A plurality of ink roller springs 30 press ink rollers 18 and 19 against type drum 3.

Figure 7:
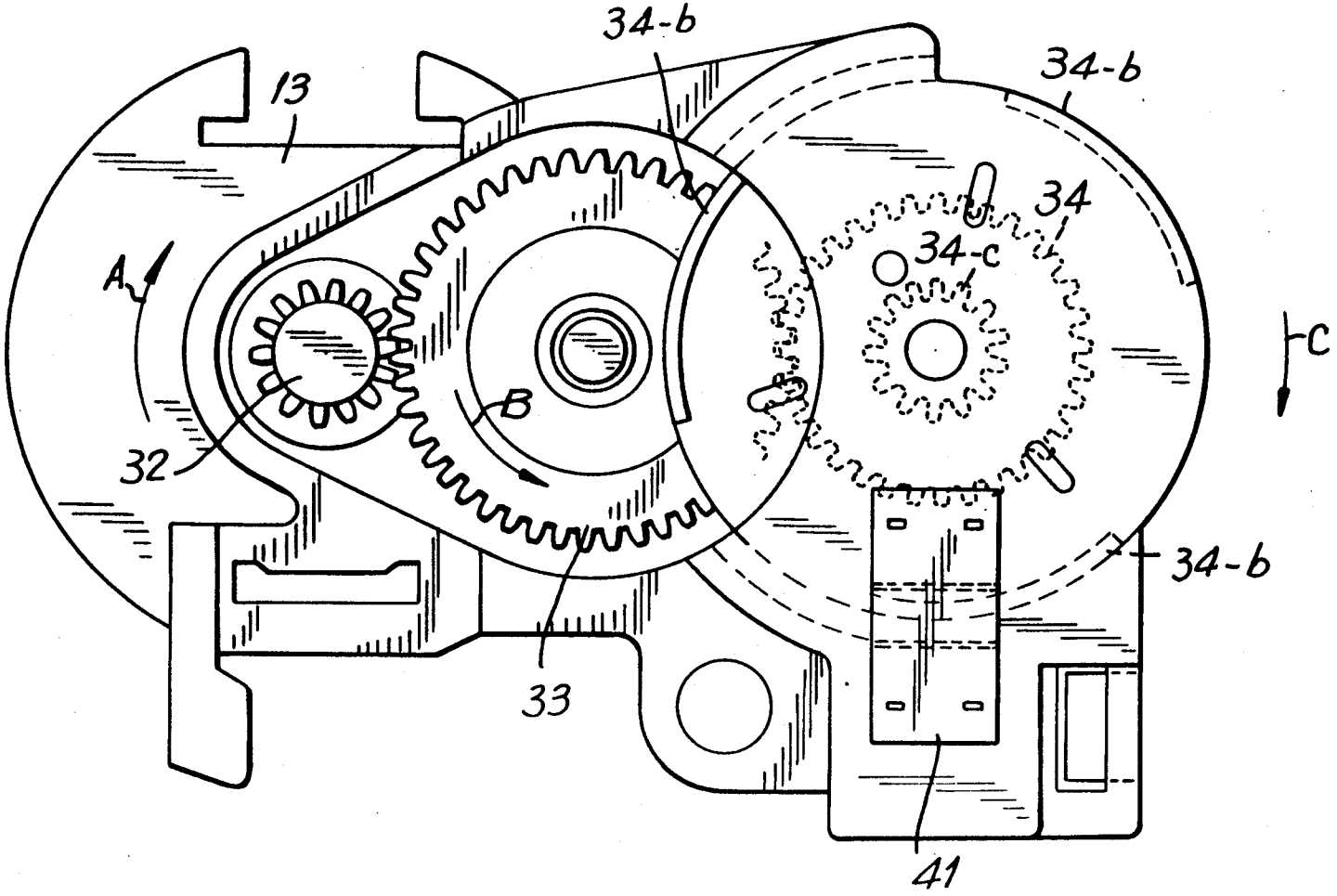
FIG. 7 is an elevational view showing a portion of the gear train.

The rotational energy generated by DC motor 11 is coupled from a motor gear 32 to a reduction gear 34 through a transfer gear 33 as shown in FIGS. 2 and 7. Gears 32, 33 and 34 turn consecutively in the directions denoted by arrows A, B and C, respectively, as shown in FIG. 7. A detection plate 34-b, a sun gear 34-c and reduction gear 34 form one unit.

Figure 10B:
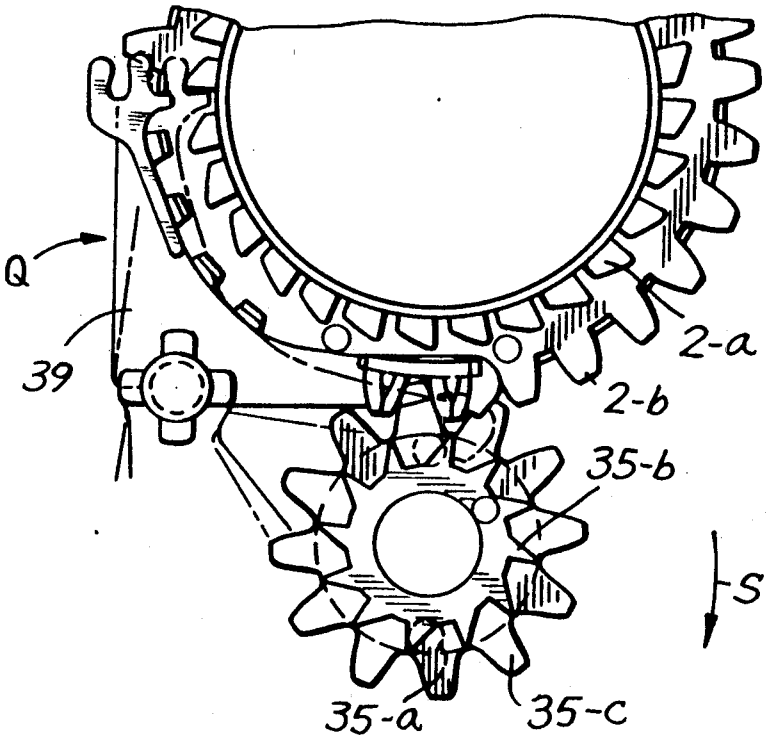
FIGS. 10(*a*) and 10(*b*) are elevational views of the selection mechanism.
Figure 10A:
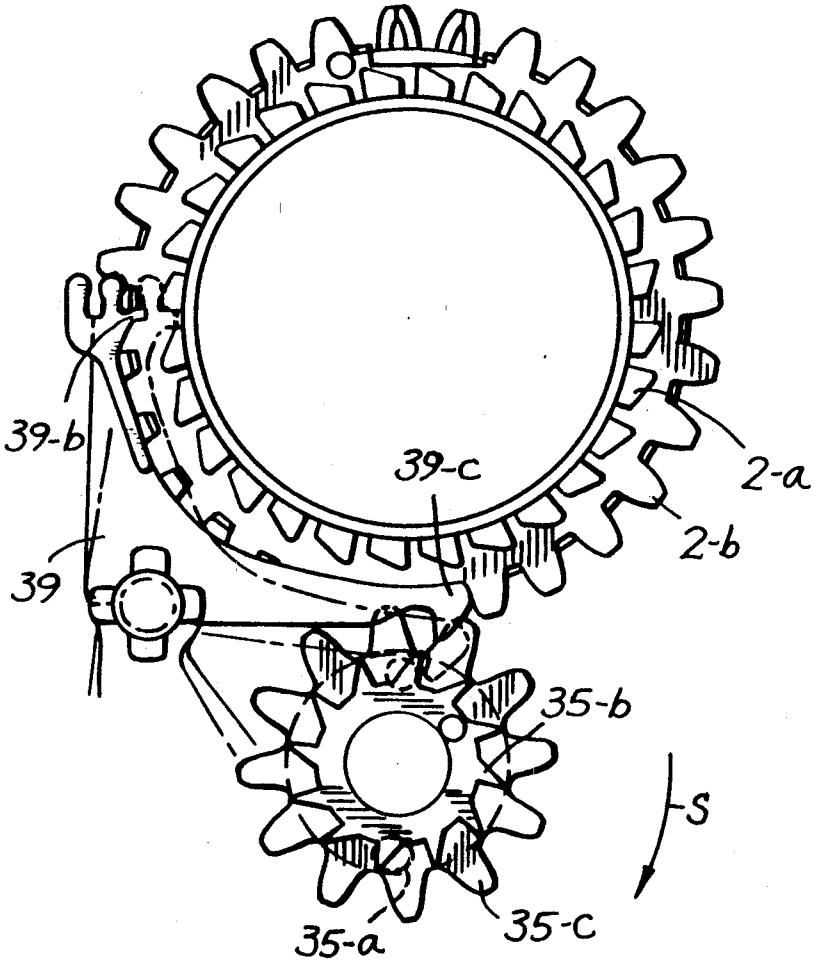

A drum drive gear 35, a pair of shafts 35-a, a latch 35-b (see FIGS. 10(*a*) and 10(*b*)) and a gear 35-c (see FIGS. 10(*b*) and 19 also form a modular unit. Shafts 35-a support a pair of corresponding planet gears 36. Latch 35-b is split in the circumferential direction at a position corresponding to the type position. Drum gear drive 35 is rotatably supported by reduction gear 34. Gear 35-c of drum drive gear 35 meshes with teeth 2-b of drum gear 2.

Figure 8B:
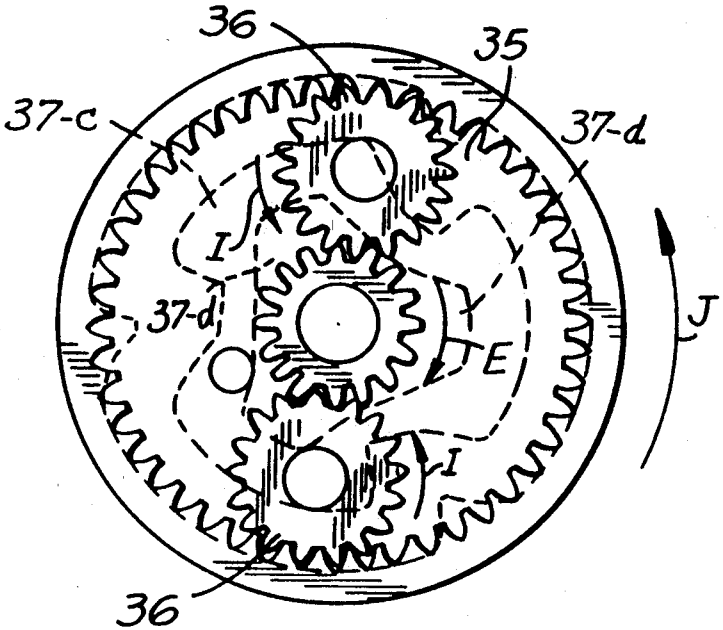
FIGS. 8(*a*) and 8(*b*) are cross sectional views of a sun-and-planet differential mechanism.
Figure 8A:
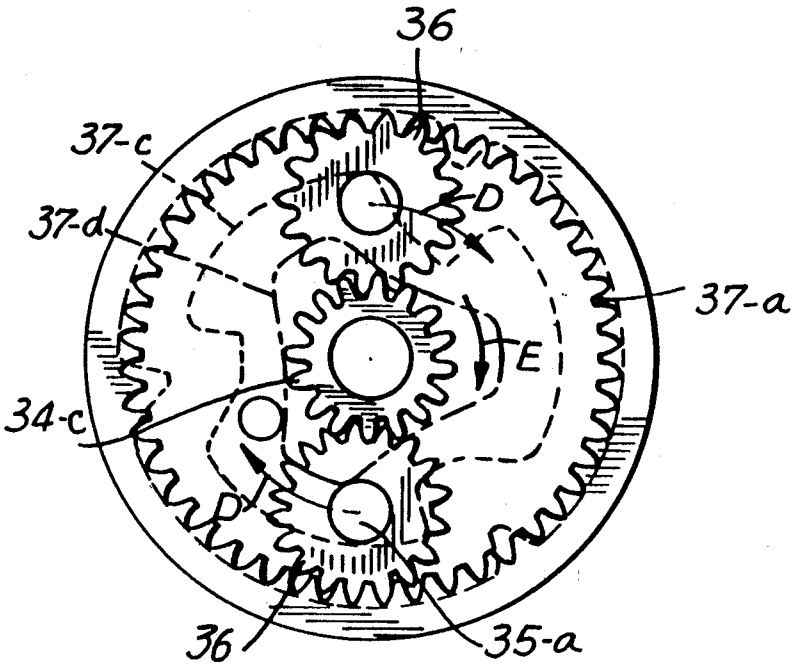
Figure 9:
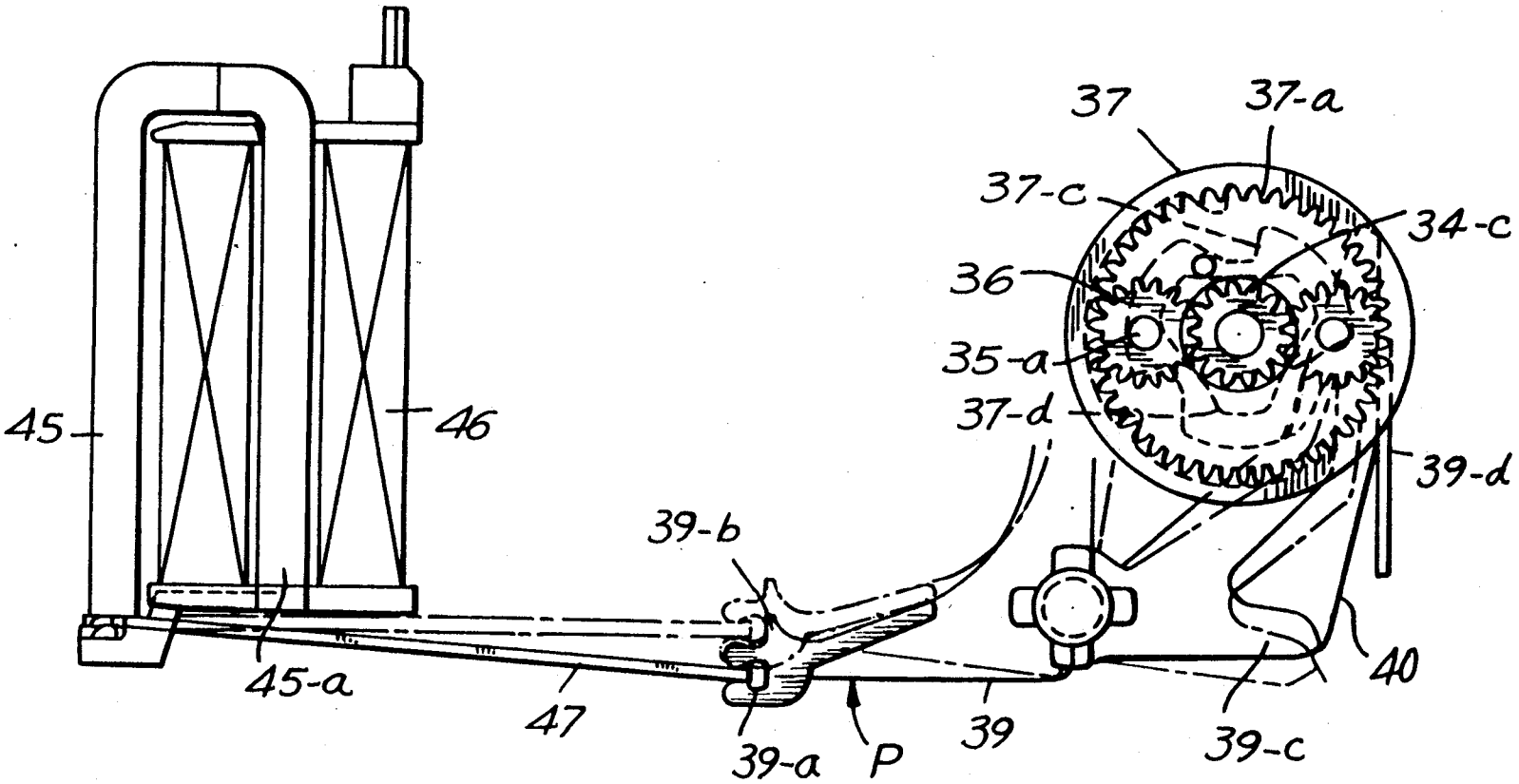
FIG. 9 is an elevational view of the selection mechanism and surrounding parts.

As shown in FIGS. 2, 8 and 9, a selection cam 37 is joined to with an inside gear 37-a, a slide cam 37-b, a control cam 37-c and a detent cam 37-d to form a modular unit. The gear train of inside gear 37-a, planet gears 36 and sun gear 34-c will hereinafter be referred to as a "sun-and-planet differential mechanism".

The sun-and-planet differential mechanism operates in two modes. In a first mode as shown in FIG. 8(*a*), inside gear 37-a is fixed. As sun gear 34-c rotates in a direction denoted by an arrow E, planet gears 36 rotate in a counterclockwise direction and travel in a direction denoted by a pair of arrows D. Drum drive gear 35 will rotate in the same direction as planet gears 36 (i.e., direction of arrows D-clockwise direction). Consequently, drum ear 2 rotates in a counterclockwise direction through gear 35-c meshing with teeth 2-b. In a second mode as shown in FIG. 8(*b*), drum drive gear shafts 35-a are fixed. As sun gear 34-c rotates in a direction denoted by arrow E, planet gears 36 rotate in a stationary position denoted by a pair of arrows I resulting in inside gear 37-a rotating in a direction denoted by an arrow J. The sun-and-planet differential mechanism operates in the first mode shown in FIG. 8(*a*) during non-type selection and in the second mode in FIG. 8(*b*) during type selection (e.g., during a printing operation). Reduction gear 34 and selection cam 37 are supported by a shaft 38.

A selection lever 39 pivots at either end in bearing 13 and frame 1 and acts on the sun-and-planet differential mechanism to switch between type selection and power transfer. As shown in FIG. 9, selection lever 39 includes a groove 39-a which engagingly receives one end of a trigger attraction plate 47, a claw 39-b, a detent 39-c and a pin 39-d. As shown in FIGS. 10(*a*) and 10(*b*), claw 39-b can engage latch 2-a of drum gear 2 to hold the latter stationary during the print operation (i.e., type drum selection). A pin 39-d of selection lever 39 can engage control cam 37-c on selection cam 37 as shown in FIG. 9. A detent spring 40 biases detent 39-c of selection lever 39 and detent cam 37-d of selection cam 37 for detent action. Detent spring 40 is attached to frame 1 by press fit into groove 1-h.

The sun-and-planet differential mechanism, selection lever 39 and detent spring 40 serve as the selection mechanism for controlling rotation of and to selectively stop drum gear 2 and type drum 3. The selection mechanism also functions for releasing an automatic stop mechanism described below.

A photodetector 41 (see FIG. 2) serves as a detection mechanism which snap fits into bearing 13. Photodetector 41 generates three timing pulses each time reduction gear 34 rotates.

Figure 11B:
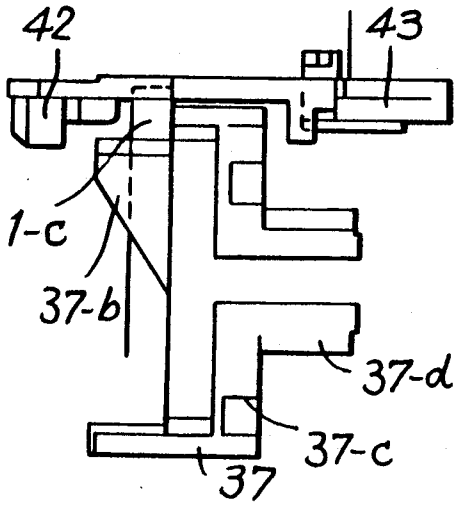
FIGS. 11(*a*) and 11(*b*) are a fragmented, side elevational and front elevational views of an automatic stop mechanism.
Figure 11A:
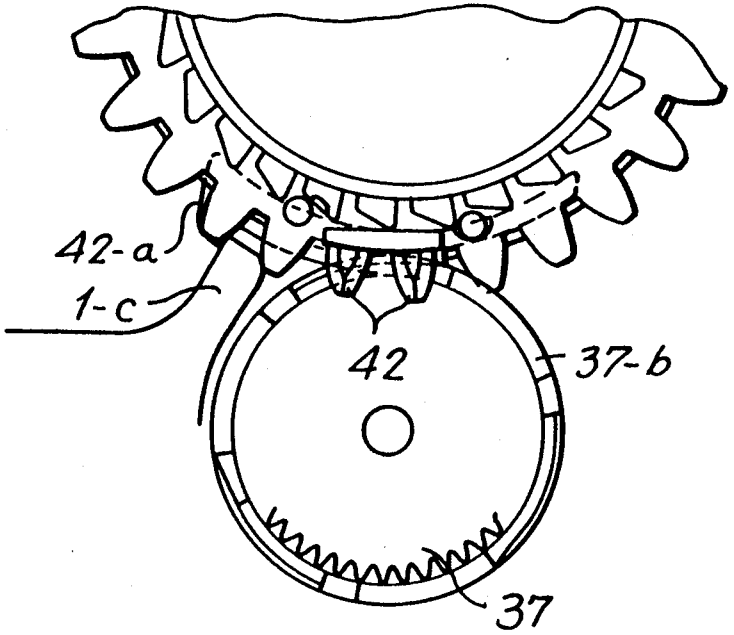
Figure 12B:
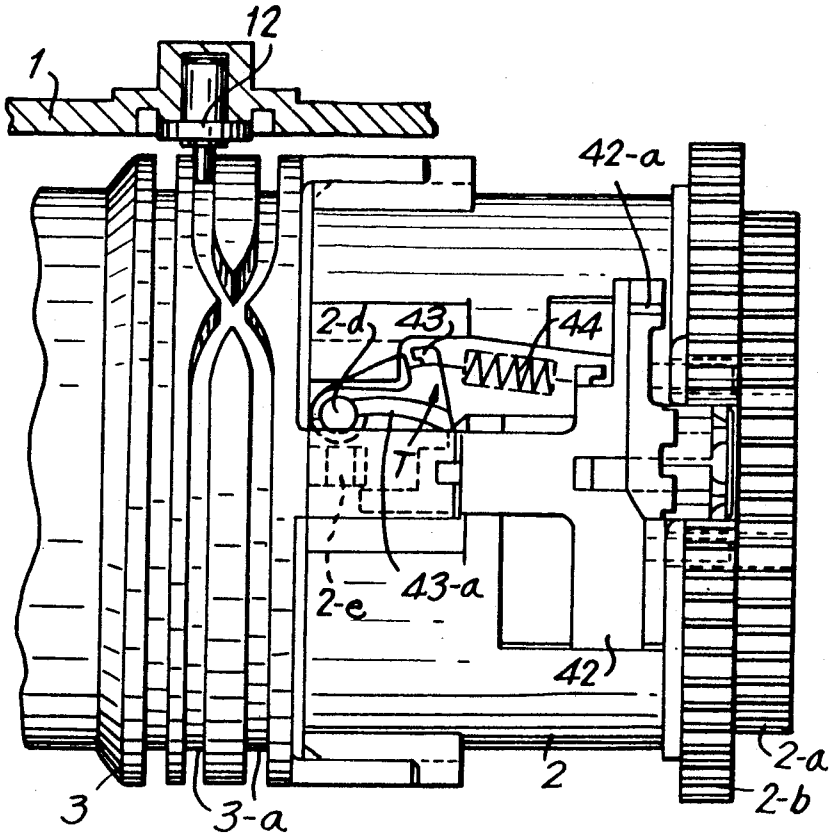
FIGS. 12(*a*), 12(*b*) and 12(*c*) are elevational views of the slide teeth and surrounding parts.
Figure 12A:
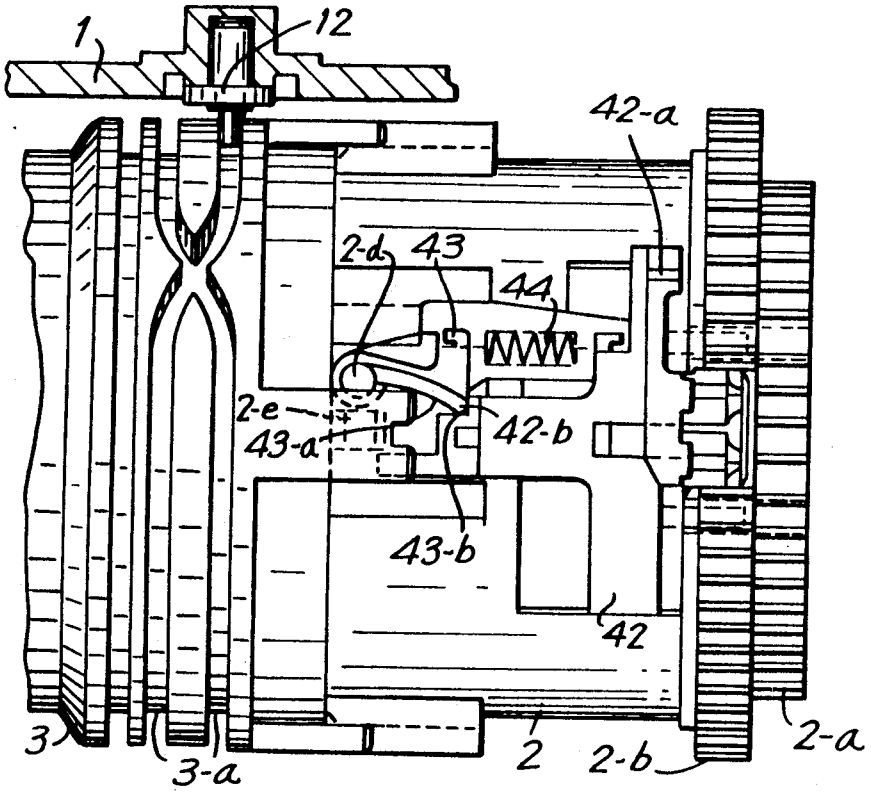
Figure 12C:
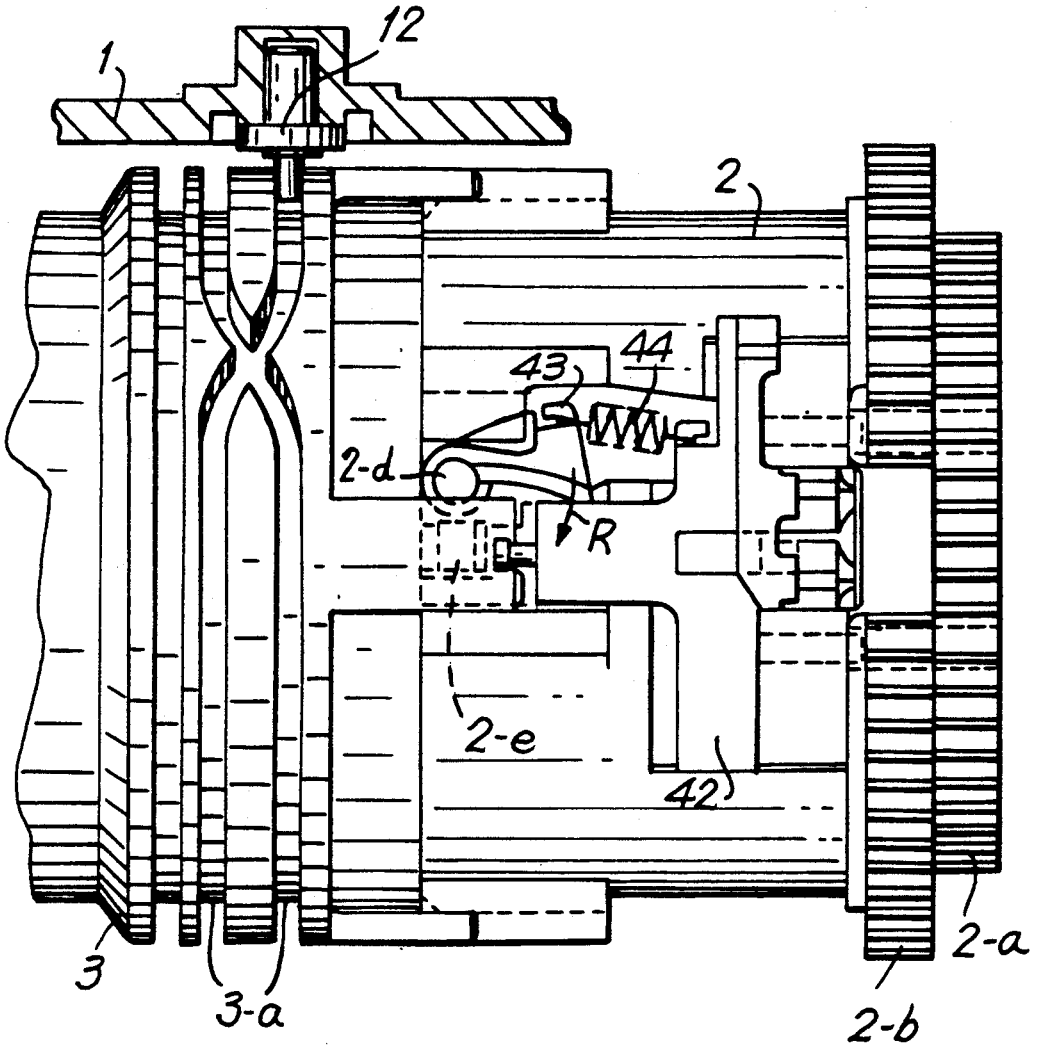

A plurality of slide teeth 42, shown in FIGS. 11 and 12 have a stopper 42-a. Slide teeth 42 slide on drum gear 2 and are biased toward the upper place columns by a slide spring 44. A retention claw 43, supported by shaft 2-d of the drum gear 2, receives a rotational force from slide spring 44. Retention claw 43 has a cam 43-a and a stopper 43-b. Slide teeth 42, retention claw 43, slide spring 44 and stopper 1-c of frame 1 serve as the automatic stopping mechanism for halting rotation of type drum 3 initially (i.e., during the initial phase).

A trigger yoke 45, which serves as the yoke for the trigger electromagnet, is press fit into the center hole of a trigger coil 46 as shown in FIGS. 16(*a*), 16(*b*) and 16(*c*). A reverse claw 45-c and a stop 45-b are formed on trigger yoke 45. Trigger yoke 45 is positioned within trigger coil 46 through insertion within a center hole of trigger coil 46 until stop 45-b contacts a raised part 46-a at the bottom of the center hole. Trigger yoke 45 is secured within trigger coil 46 by a reverse claw of trigger yoke 45 digging into the inside wall of the center hole of trigger coil 46. As shown in FIGS. 9, 16(*d*) and 16(*e*), trigger attraction plate 47 is pulled toward the core 45-a of trigger yoke 45 by the magnetic field generated when trigger coil 46 is energized. One end of trigger attraction plate 47 fits into groove 39-a of selection lever 39 and rotates (i.e. swings) selection level 39 by a predetermined angle so as to position selection lever 39 as shown in FIG. 9 by the dashed lines. Trigger yoke 45, trigger coil 46 and trigger attraction plate 47 serve as the trigger mechanism.

Figure 18:
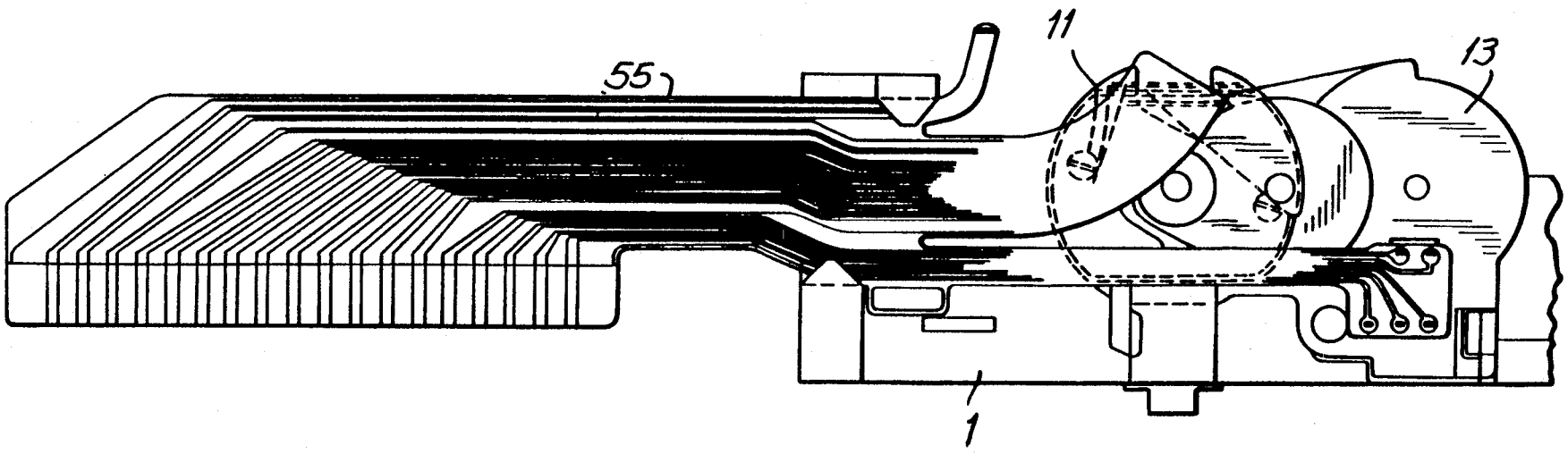
FIG. 18 is a side elevational view of a flexible printed circuit (FPC) and surrounding parts.
Figure 19:
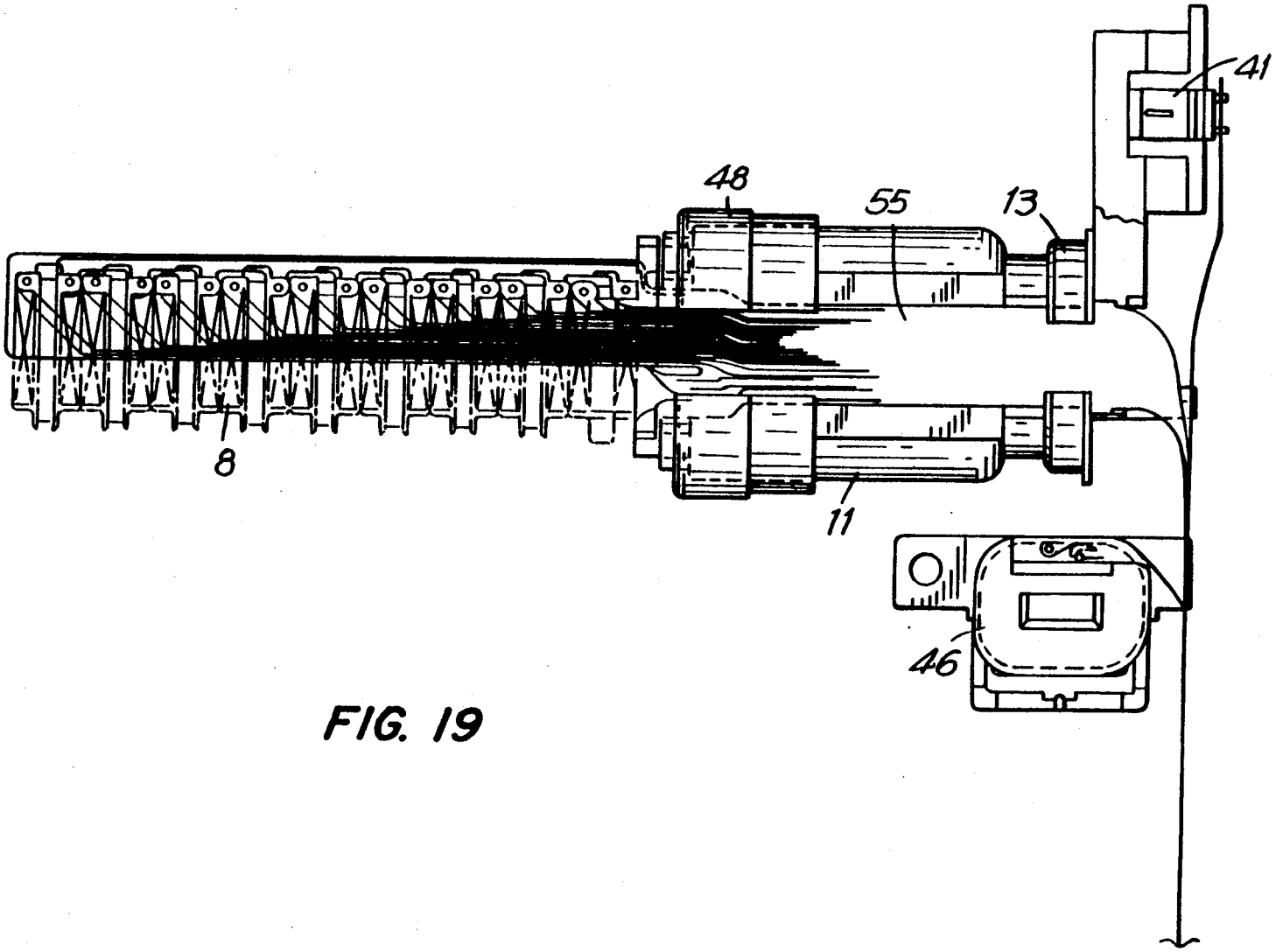
FIG. 19 is a top plan view, in cross section, of the FPC of FIG. 18.

As shown in FIGS. 18 and 19, a flexible printed circuit (FPC) 55 is connected to the terminals of print coil 8 and DC motor 11. Connection to DC motor 11 can be either inside type drum 3 or drum gear 2. After passing through intermediate bearing 48, over the top of DC motor 11 and through bearing 13, FPC 55 is pulled over the outside of type drum 3 or drum gear 2. FPC 55 is also connected to an FPC which is connected to the terminals of photodetector 41 and trigger coil 46 and serves as the connection terminals for the control circuit.

Operation of printer 100, beginning with the selection mechanism, is as follows.

Drum Rotation

When selection lever 39 is in the operating state denoted by the solid lines in FIGS. 9 and 10(*a*), drum drive gear 35 is rotating and selection cam 37 is stationary. Selection cam 37 is maintained in a stationary state by pin 39-d of selection lever 39 engaging control cam 37-c of selection cam 37. Detection plate 34-b positioned at the top of reduction gear 34 includes three protrusions 34-b' (see FIG. 2) positioned approximately 120° apart from each other. Each time photodetector 41 senses the next protrusion 34-b' as the latter rotates, photodetector 41 generates a timing pulse. In other words, photodetector 41 generates a timing pulse for every one-third of a revolution of reduction gear 34.

Type drum 3 is divided up into 28 positions about its circumference. The reduction ratio of reduction gear 34 is set so that type drum 3 rotates 1/28 of a revolution for every ⅓ of a revolution of reduction gear 34. In order to achieve such rotation, sun gear 34-c of reduction gear 34 and planet gears 36 each have 14 teeth and inside gear 37-c of selection cam has 42 teeth. The reduction ratio from reduction gear 34 to drum drive gear 35 is ¼. Gear 35-c and latch 35-b of drum drive gear 35 each have 12 teeth. The reduction ratio is therefore set so that drum drive gear 35 turns 1/12 of a revolution when reduction gear 34 turns ⅓ of a rotation.

Selection Mode

When selection lever 39 is in the operating state denoted by the dashed lines in FIGS. 9 and 10(*a*), drum gear 2 and drum drive gear 35 are stationary and selection cam 37 rotates. Pin 39-d of selection lever 39 temporarily engages and holds and then releases control cam 37-c (a three-part grooved heart-shape cam) of selection cam 37. Selection cam 37 turns ⅓ of a rotation and then stops based on the interlocking positions of pin 39-d and control cam 37-c. Once selection cam 37 is unable to rotate, drum drive gear 35 turns. The reduction ratio is set so that reduction gear 34 turns one complete revolution when selection cam 37 rotates ⅓ of a revolution.

As long as DC motor 11 is operating, timing pulses are continuously being generated by photodetector 41. The reduction ratio from the input shaft of the sun-and-planet differential mechanism, which is the principal part of the selection mechanism, to the output shaft is always an integral ratio.

Figure 20:
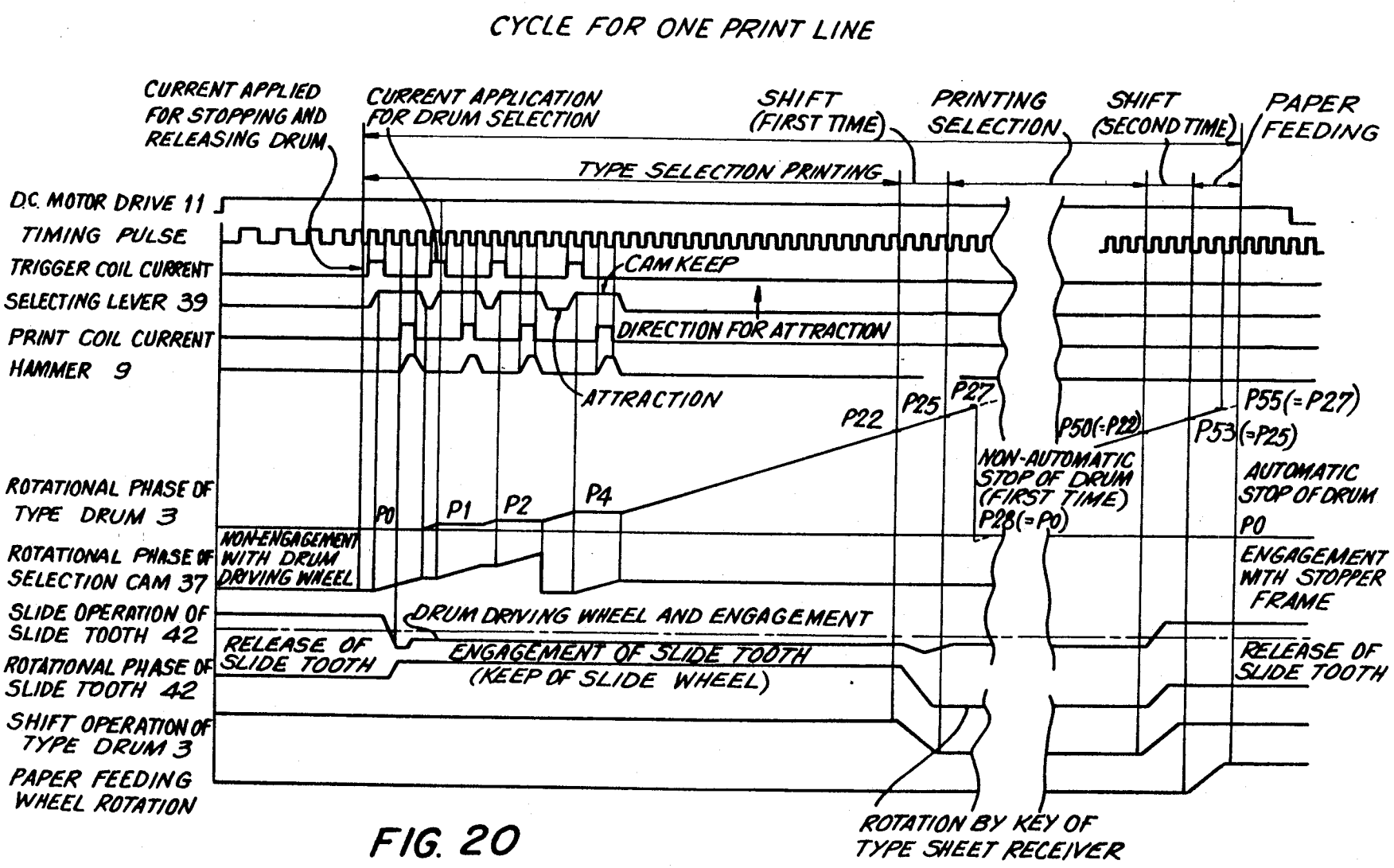
FIG. 20 is a timing chart illustrating the operation of several mechanisms within the type printer.

The sequential operation in printing one-line on a recording medium (piece of paper) follows; the printing cycle for one print line being completed after revolution of type drum 3 as shown in FIG. 20.

Start of Rotation for Type Drum 3

The printing cycle for one line begins by energizing DC motor 11. When DC motor 11 rotates, drum drive gear 35 begins rotating. In the initial state of type drum 3, slide teeth 42 are not within a notch of notched gear 2-b. Consequently, gear 35-c cannot mesh with notched gear 2-b and requires insertion of slide teeth 42 within the notch to begin rotation of type drum 3. More particularly, with slide teeth 42 inserted into the notch, gear 35-c meshes with slide teeth 42.

Referring once again to FIGS. 9 and 10(*a*), type drum 3 is initially in a stationary position (hereinafter referred to as "automatic stopping" of type drum 3). When trigger coil 46 is energized in synchronism with the timing pulses generated by photodetector 41, attraction plate 47 is pulled toward trigger coil 46 and selection lever 39 rotates in the directions denoted by a pair of arrows P and Q in FIGS. 9 and 10(*b*), respectively, and as further indicated by the broken lines therein. Detent 39-c of selection lever 39 engages ratchet 35-b of drum drive gear 35 so as to halt rotation of the latter. Selection cam 37 is now free to rotate upon application of the rotational energy from the sun-and-planet gear mechanism.

Slide teeth 42 are pushed toward the lower place columns and against the spring force of slide spring 44 every ⅓ of a revolution of selection cam 37 by engagement with slide cams 37-b. Slide cams 37-b are located every 120 degrees about the circumference of selection cam 37. When slide teeth 42 are moving, retention claw 43 sitting against slide teeth 42 rotates in the direction of an arrow R shown in FIG. 12(*c*). When the engagement of slide teeth 42 with slide cam 37-b of selection cam 37 is released, slide teeth 42 move slightly back toward the lower place columns by slide spring 44 before contracting retention claw 43 as shown in FIG. 12(*a*).

When selection cam 37 turns ⅓ of a rotation, pin 39-d of selection lever 39 slides along the outer surface profile of control cam 37-c which is on the rear side of selection cam 37. Selection lever 39 thereby returns to the position indicated by the solid lines in FIG. 9, and at the same time, selection cam 37 stops rotating and drum drive gear 35 begins rotating. Simultaneously, slide teeth 42 engage drum drive gear 35. Slide teeth 42, drum drive gear 35 and drum gear 2 begin rotating as a single unit in a direction denoted by an arrow S in FIG. 10(*b*). Therefore, type drum 3 and drum gear 2 are released from the initial automatically stopped state.

Initialization of the Type Drum Position

In printing, the position of type drum 3 is initialized in both the direction of rotation and the column direction. This initialization need not be performed after completing one line of print since drum gear 2, type drum 3 and slide teeth 42 are returned to the initial phase (automatic stopped state). Rather, initialization of type drum 3 occurs by energizing trigger coil 42 after 56 pulses have been counted by photodetector 41. Slide teeth 42 are positioned toward the lower place columns and stopper 42-a of slide teeth 42 is in contact with stopper 1-c of frame 1 (see FIG. 11(*a*)). Slide teeth 42 are not positioned for engagement with drum drive gear 35. The rotational energy of motor 11 therefore cannot be transferred from drum drive gear 35 to drum gear 2. Drum gear 2 is automatically stopped in its initial phase (see FIG. 12(*a*)). Type drum 3, which is connected to drum gear 2 through engagement of keys 3-c of type drum 3 with key grooves 2-c of drum gear 2, is in a predetermined stationary position.

Type Selection and Printing (First Rotation of Type Drums)

Selection of type 4-a begins by energizing trigger coil 46 based on the timing required for each type character. When trigger coil 46 is energized, selection lever 39 rotates in the direction of arrows P and S shown in FIGS. 9 and 10(*b*) and is indicated by the dashed lines, respectively. Once latch 2-a of drum gear 2 is engaged by claw 39-b of selection lever 39, drum gear 2 stops rotating. Selection cam 37 is now free to rotate. During rotation of selection cam 37, pin 39-d of selection lever 39 remains in contact with and slides on the exterior surface of control cam 37-c, control cam 37-c being on the rear surface of selection cam 37. Drum gear 2 remains in a stationary state. A timing pulse is repeatedly generated by photodetector 41 based on the continuous rotation of reduction gear 34. Print coils 8, associated with the desired column, are energized in synchronism with timing pulses. Hammers 9 are attracted towards energized print coils 8 and thereby strike corresponding type 4-a against the paper to print a selected type 4-a (see FIG. 4). The printing color corresponding to the column position remains the same as long as type drum 3 does not shift.

The plurality of type 4-a on type sheet 4 is staggered as shown in FIG. 2. Adjacent type 4-a are not within the same column. Consequently, simultaneous printing by contact of hammer 9 with two adjacent type 4-a within the same column is prevented.

When selection cam 37 turns ⅓ of a rotation after type selection, selection lever 39 is released, as described above, so selection cam 37 stops rotating and drum gear 2 once again begins to rotate.

Inside type drum 3, as shown in FIGS. 17(*a*) and 17(*b*), damper spring 54 biases damper wheel 53 toward the upper place columns of type 4*a*. Damper spring 54 is a flat spring with a center hole. In conventional printers, the mechanical stop and drive forces applied to type drum 3 would create vibrational and rotational fluctuations in type drum 3. Vibration of type 4-a during printing can result and degrade the print quality. Rotational fluctuation immediately after driving type drum 3 can cause incorrect type selection when selection of the next type occurs. Damper wheel 53 and damper spring 54 act as a damping mechanism which reduces such vibrational and rotational fluctuation.

Figure 21B:
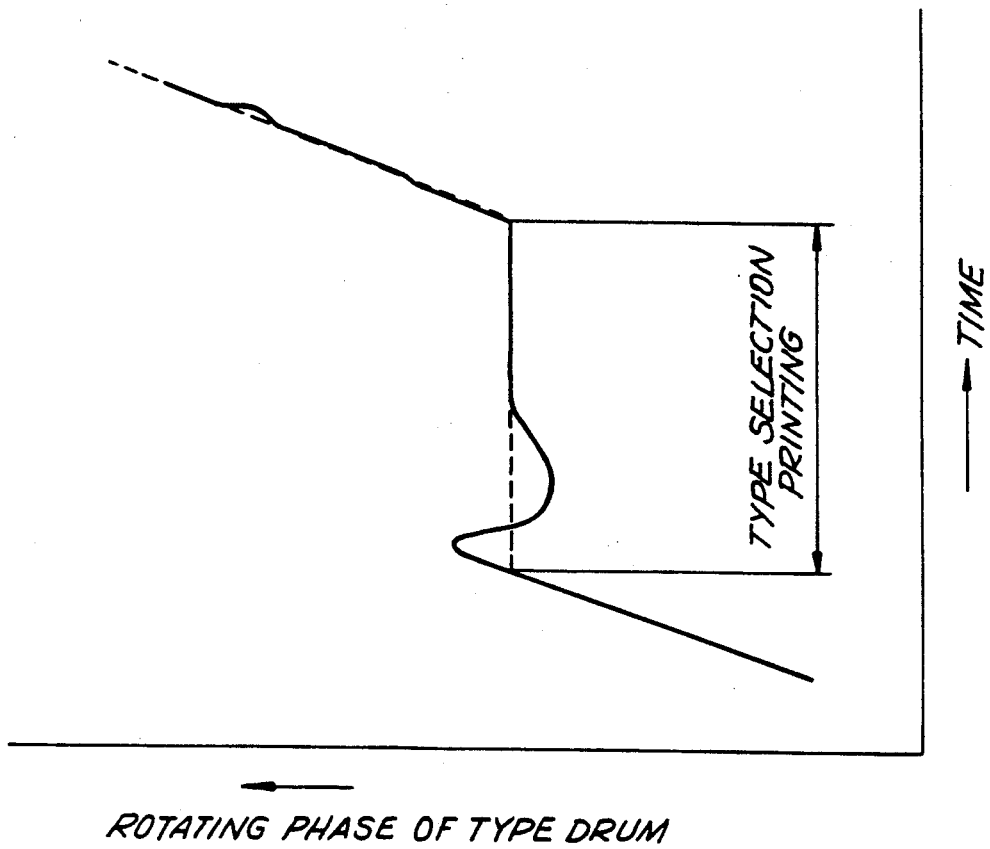
FIGS. 21(*a*) and 21(*b*) are plots of rotating phase of the type drum versus time.
Figure 21A:
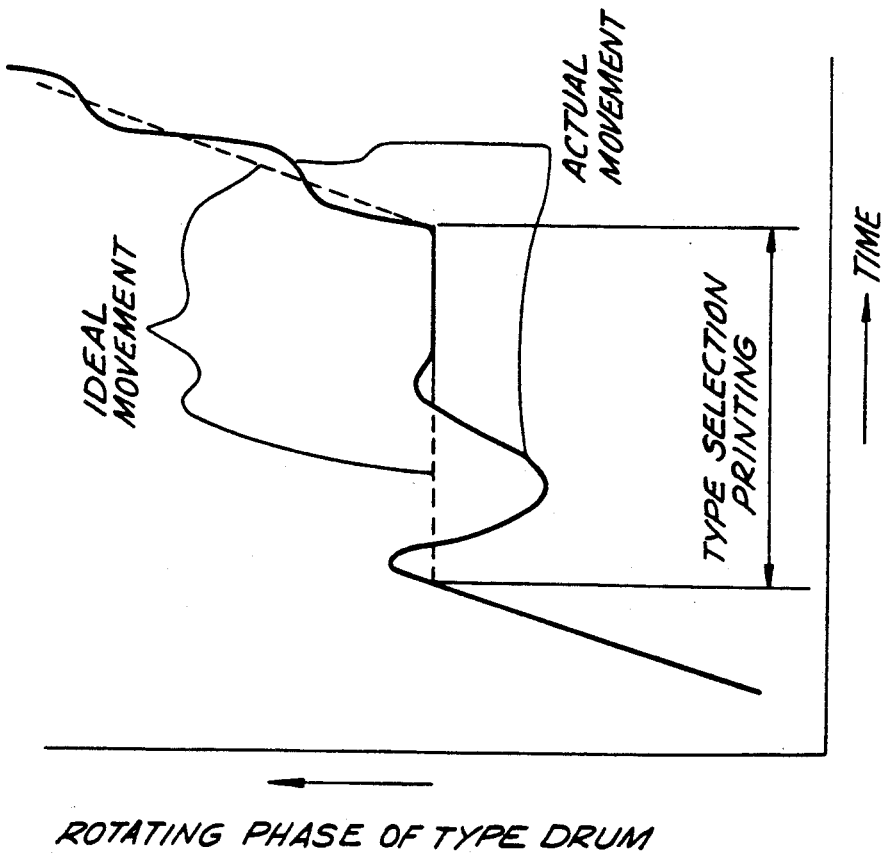
Figure 22:
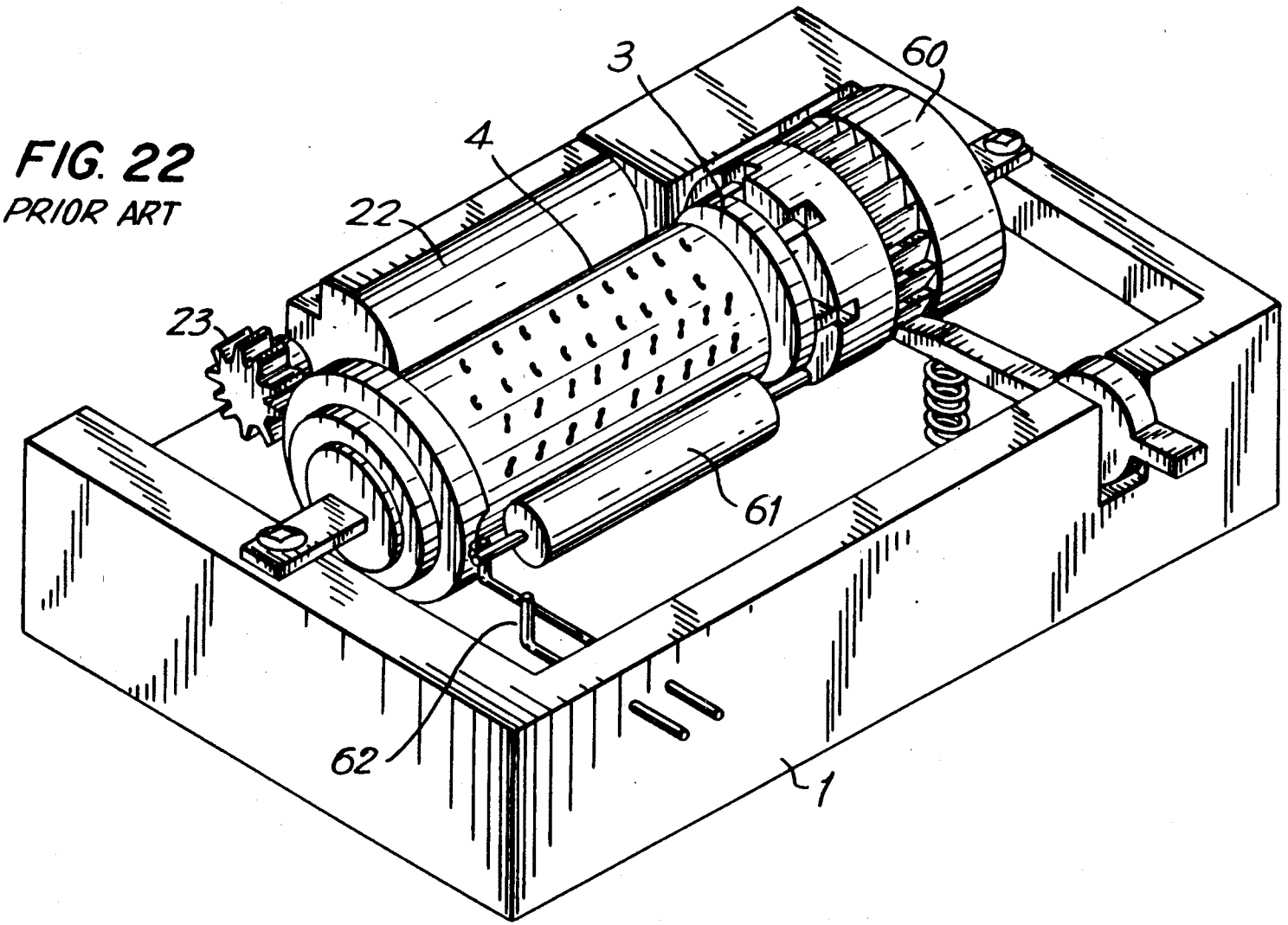
FIG. 22 PRIOR ART
FIG. 22 is a perspective view of a conventional type drum printer.

FIG. 21(*a*) shows the selection behavior of type drum 3 without the damping mechanism of damper wheel 53 and damper spring 54. The damping mechanism in accordance with the invention, however, substantially dampens such vibrational and rotational fluctuation immediately after type drum 3 has stopped, as shown in FIG. 21(*b*). Rotational fluctuation is substantially reduced immediately after driving type drum 3 again. More particularly, type drum 3 receives a negative angular acceleration immediately after coming to rest. The inertia of type drum 3 causes damper wheel 53 to continue rotating in the forward direction. An angular velocity difference relative to type drum 3 results. The angular velocity difference creates a frictional torque at the contact surfaces between damper spring 54 and damper wheel 53 and between damper wheel 53 and type drum 3. These frictional torques act to cancel out the negative angular acceleration on type drum 3.

Immediately after type drum 3 is driven again, rotational fluctuation is generated by the impact of the driving force on type drum 3 and by the elasticity and backlash in the gear train. The inertia of type drum 3, however, causes damper wheel 53 to continue to rotate at a fixed angular velocity. An angular velocity difference occurs between damper wheel 53 and type drum 3. The frictional torques described above, now acts in a direction which suppresses velocity fluctuation in type drum 3 rotation.

Shifting of the Type Drum (First Rotation of Type Drum 3)

Just before type drum 3 completes one revolution, type drum 3 begins shifting from the upper place columns toward the lower place columns of type 4-a. Such shifting occurs as type drum 3 rotates by stationary rotor 12 sliding within cam groove 3-a so as to move type drum 3 one column toward the lower place columns. One of the four keys 3-c of type drum 3 pushes against cam surface 43-a of retention claw 43 so as to turn retention claw 43 in the direction of an arrow T shown in FIG. 12(*b*). Slide teeth 42 are pushed so that they slide toward the lower place columns of type sheet 4. Slide teeth 42 (typically, numbering about 2) are now positioned for meshing with gear 35-c of drum drive gear 35 in the column direction (see FIG. 12(*b*)).

Type Selection and Printing (Second Rotation of Type Drum 31)

After type drum 3 begins its second revolution, the type selection and printing process described above is repeated. The desired print color now can be selected by repositioning the column position of type drum 3. If necessary, the column position of type drum 3 can be changed from the column position of type drum 3 during the first revolution of type drum 3. Therefore, columns can be printed which could not be printed in the desired print color during the first revolution of type drum 3.

Shifting of the Type Drum (Second Rotation of Type Drum 3)

Just before type drum 3 completes its second revolution, type drum 3 begins shifting toward its upper place columns. Such shifting occurs as type drum 3 rotates by stationary rotor 12 traveling within cam groove 3-a so as to move type drum 3 one column toward the upper place columns of type drum 3. After one of the four keys 3-c of type drum 3 pushes against cam surface 43-a of retention claw 43 while such shifting occurs, stop 43-b of retention claw 43 rides over stop 42-b of slide teeth 42. Slide teeth 42 are thereby no longer held in a stationary position by retention claw 43. Movement toward the upper place columns by slide teeth 42 is provided by the spring force of slide spring 44 together with the shifting of type drum 3. Such movement by slide teeth 42 is halted through contact with protrusion 2-e of drum gear (see FIG. 12(*c*)). In this state, the teeth of slide teeth 42 are at a position where they cannot mesh with gear 35-c of drum drive gear 35 in the circumferential direction.

Paper Feed

Immediately after the second shift and immediately before completion of the second revolution of type drum 3, the paper feed process begins. Type drum 3 is positioned along the upper place columns as shown in FIG. 14. Paper feed drive gear 3-d of type drum 3 and paper feed gear 23 are positioned to mesh with one another. As type drum 3 rotates, paper feed drive gear 3-d drives paper feed gear 23 so that paper feed gear 23 rotates by a predetermined amount to advance the paper by one print line.

Automatic Stopping

After the second shift process and paper feed process, slide teeth 42 are out of position to mesh with gear 35-c of drum drive gear 35 in the column direction. Once stopper 42-a of slide teeth 42 contacts stopper 1-c of the frame 1, slide teeth 42 are prevented from moving any further towards the upper place columns of type drum 3. Gear 2-b of drum gear 2 is positioned so that the notch therein is opposite drum drive gear 35 to prevent coupling of the rotary energy from drum drive gear 35 to drum gear 2. Drum gear 2 therefore stops rotating. Drum gear 2 and type drum 3 remain in an automatically stopped state until trigger coil 46 is once again energized. This state is equivalent to the state after initialization described above.

As described above, a printer 100 includes a print electromagnet and hammers 9 housed in type drum 3 with hammers 9 striking type 4*a* from inside type drum 3. In accordance with an alternative embodiment of the invention, however, the type print can be pushed from outside type drum 3 for use with, for example, impact printers.

A two-color type parallel printer including ink rollers has been employed in the preferred embodiment described above. It is to be understood, however, that the invention also may be applied to ink ribbon, single-color, three-color and serial type printers. The invention also is not limited to printers in which the print electromagnet and hammer are housed within the type drum. The driving source is also not limited to a DC motor and can include an AC motor. Furthermore, a coil spring, rather than a flat spring, can be used for the damper spring.

As now can be readily appreciated, printer 100 includes a type drum to which at least two colors are alternately applied in the column direction and is alternately shifted in the column direction for each revolution of the type drum. When the type drum has completed two revolutions, it is automatically stopped at its initial starting position. The selection and stop release mechanism rotates the type drum, selects type, and releases the automatically stopped condition of the type drum when printing of the next print line is to begin. The selection mechanism is controlled by energizing the trigger mechanism in synchronism with a pulse corresponding to the type position on the type drum and generated by the timing pulse detection mechanism. The series of operations is performed using the power from an efficient, compact DC motor as a drive source.

The invention provides a compact, low powered, high speed drum printer. By avoiding use of a step motor, reset pulse detector and other expensive elements, the printer can be manufactured at a relatively low cost. The printer can be driven by an extremely simple control method using low cost control circuits and software.

Since the timing pulse is generated from the detection mechanism during type selection, the hammer drive in the printing process (i.e., powering of the print electromagnet) can be performed in synchronism with the timing pulse. The timing pulse can be used during rotation of the type drum to count the type position and determine the timing for driving the selection mechanism.

Type printers in accordance with the invention can be driven by an extremely simple control method and a low cost drive circuit, and since low cost control circuits and software can be used, calculators and cash registers can be offered at low cost and require less time for development of the control circuitry.

Furthermore, since the damper wheel continues to rotate at a constant velocity due to inertia, an angular velocity difference is generated between the type drum and the damper wheel when vibrational or rotational fluctuation occurs in the type drum. The angular velocity difference causes frictional torque at the contact surface between the damper spring and the damper wheel which suppresses the vibrational or rotational fluctuation in the type drum.

Degradation of print quality due to vibration during printing or incorrect type selection during the next type selection due to rotational fluctuation immediately after the type drum has been driven is prevented. The speed and reliability of the type printer is thereby improved.

Still further, the spacing within the type drum or inside the drum gear which is part of the selection mechanism can be used to house the motor. A more compact printer results. By providing that one end of the yoke of the print electromagnet passes through the space between the inside of the type drum or the drum gear and the outside of the motor, the print electromagnet within the type drum can be secured to the printer body. Consequently, rotational noise generated by the motor is muffled (i.e., blocked). The level of noise during operation of the printer is greatly reduced.

It will thus be seen that the objects set forth above and those made apparent from the preceding description are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A type printer, comprising:

rotatable type drum means for providing type; said rotatable type drum means a predetermined operating position prior to initial rotation thereof;

driving means for applying a driving force to said rotatable type drum means to rotate said rotatable type drum means, said driving means including a motor;

detecting means for detecting operation of said motor and producing a synchronizing pulse in response thereto;

driving control means for controlling said driving means in response to said synchronizing pulse and including a selection lever and cam means, said selection lever coupled directly to and for controlling the position of said cam means, said position of said cam means determining the control applied by said driving control means to said driving means to control the application of the driving force to the type drum means; and disabling means for disabling said driving means following two complete revolutions of said rotatable type drum means beginning at said predetermined operating position to remove application of said driving force to said rotatable type drum means in response to said synchronizing pulse, said motor continuing to operate when said driving force is not applied to said type drum means, said disabling means including means for rendering said disabling means inoperable until said two revolutions have been completed.

2. The type printer of claim 1, wherein said disabling means is operable for disabling said driving means when said rotatable type drum means is at said predetermined operating position.

3. The type printer of claim 1, further including disabling control means for controlling said disabling means.

4. The type printer of claim 3, wherein said disabling control means serves as said driving control means.

5. The type printer of claim 4, further including trigger means for initiating operation of said disabling control means and said driving control means.

6. The type printer of claim 1, wherein said type is on the surface of said rotatable type drum means and forms a pattern in which adjacent type in adjacent rows is staggered.

7. The type printer of claim 2, wherein said type is on the surface of said rotatable type drum means and forms a pattern in which adjacent type in adjacent rows is staggered.

8. The type printer of claim 3, wherein said type is on the surface of said rotatable type drum means and forms a pattern in which adjacent type in adjacent is staggered.

9. The type printer of claim 4, wherein said type is on the surface of said rotatable type drum means and forms a pattern in which adjacent type in adjacent rows is staggered.

10. The type printer of claim 5, wherein said type is on the surface of said rotatable type drum means and forms a pattern in which adjacent type in adjacent rows is staggered.

11. The type printer of claim 1, wherein said driving means includes a notched gear having a notch and a plurality of teeth except within said notch and wherein said disabling means includes tooth means having one or more teeth for insertion into or removal from said notch.

12. The type printer of claim 2, wherein said driving means includes a notched gear having a notch and a plurality of teeth except within said notch and wherein said disabling means includes tooth means having one or more teeth for insertion into or removal from said notch.

13. The type printer of claim 3, wherein said driving means includes a notched gear having a notch and a plurality of teeth except within said notch and wherein said disabling means includes tooth means having one or more teeth for insertion into or removal from said notch.

14. The type printer of claim 4, wherein said driving means includes a notched gear having a notch and a plurality of teeth except within said notch and wherein said disabling means includes tooth means having one or more teeth for insertion into or removal from said notch.

15. The type printer of claim 5, wherein said driving means includes a notched gear having a notch and a plurality of teeth except within said notch and wherein said disabling means includes tooth means having one or more teeth for insertion into or removal from said notch.

16. The type printer of claim further including shifting means for moving said rotatable type drum means in reciprocating linear directions in response to said driving force.

17. The type printer of claim 2, further including shifting means for moving said rotatable type drum means in reciprocating linear directions in response to said driving force.

18. The type printer of claim 3, further including shifting means for moving said rotatable type drum means in reciprocating linear directions in response to said driving force.

19. The type printer of claim 4, further including shifting means for moving said rotatable type drum means in reciprocating linear direction in response to said driving force.

20. The type printer of claim 5, further including shifting means for moving said rotatable type drum means in reciprocating linear directions in response to said driving force.

21. The type printer of claim 11, further including shifting means for moving said rotatable type drum means in reciprocating linear directions in response to said driving force.

22. The type printer of claim 21, further including a frame and a projection from said frame, and wherein said rotatable type drum means includes a pair of grooves encircling said rotatable type drum means and crossing over one another, said projection positioned within one of said groove, said projection and grooves serving as said shifting means wherein said rotatable type drum means upon application of said driving force by said driving means moves in one of two reciprocating directions based on the position of said projection within said grooves.

23. The type printer of claim 12, further including shifting means for moving said rotatable type drum means in reciprocating linear directions in response to said driving force.

24. The type printer of claim 23, further including a frame and a projection protruding from said frame, and wherein said rotatable type drum means includes a pair of grooves encircling said rotatable type drum means and crossing over one another, said projection positioned within one of said grooves, said projection and grooves serving as said shifting means wherein said rotatable type drum means upon application of said driving force by said driving means moves in one of two reciprocating directions based on the position of said projection within said grooves.

25. The type printer of claim 13, further including shifting means for moving said rotatable type drum means in reciprocating linear directions in response to said driving force.

26. The type printer of claim 14, further including shifting means for moving said rotatable type drum means in reciprocating linear directions in response to said driving force.

27. The type printer of claim 15, further including shifting means for moving said rotatable type drum means in reciprocating linear directions in response to said driving force.

28. The type printer of claim 4, wherein said driving control means further includes a sun-and-planet gear mechanism and a gear having teeth facing radially inwardly, said selecting lever coupled to said sun-and-planet gear mechanism and cam means.

29. The type printer of claim 5, wherein said trigger means includes an electromagnet, a coil and coupling means for coupling movement of said coil to said disabling control means and to said driving control means.

30. The type printer of claim 5, wherein said driving control means further includes a sun-and-planet gear mechanism and a gear having teeth facing radially inwardly, said selecting lever coupled to said sun-and-planet gear mechanism and cam means.

31. The type printer of claim 30, wherein said trigger means includes an electromagnet, a coil and coupling means for coupling movement of said coil to said disabling control means and to said driving control means.

32. The type printer of claim 14, wherein said driving control means further includes a sun-and-planet gear mechanism and a gear having teeth facing radially inwardly, said selecting lever coupled to said sun-and-planet gear mechanism and cam means.

33. The type printer of claim 15, wherein said driving control means includes a sun-and-planet gear mechanism and a gear having teeth facing radially inwardly, said selecting lever coupled to said sun-and-planet gear mechanism and cam means.

34. The type printer of claim 33, wherein said trigger means includes an electromagnet, a coil and coupling means for coupling movement of said coil to said disabling control means and to said driving control means.

35. The type printer of claim 19, wherein said driving control means further includes a sun-and-planet gear mechanism and a gear having teeth facing radially inwardly, said selecting lever coupled to said sun-and-planet gear mechanism and cam means.

36. The type printer of claim 20, wherein said driving control means further includes a sun-and-planet gear mechanism and a gear having teeth facing radially inwardly, said selecting lever coupled to said sun-and-planet gear mechanism and cam means.

37. The type printer of claim 36, wherein said trigger means includes an electromagnet, a coil and coupling means for coupling movement of said coil to said disabling control means and to said driving control means.

38. The type printer of claim 26, wherein said driving control means further includes a sun-and-planet gear mechanism and a gear having teeth facing radially inwardly, said selecting lever coupled to said sun-and-planet gear mechanism and cam means.

39. The type printer of claim 27, wherein said driving control means includes a sun-and-planet gear mechanism and a gear having teeth facing radially inwardly, said selecting lever coupled to said sun-and-planet gear mechanism and cam means.

40. The type printer of claim 39, wherein said trigger means includes an electromagnet, a coil and coupling means for coupling movement of said coil to said disabling control means and to said driving control means.

41. The type printer of claim 1, wherein said type is at predetermined positions on said rotatable drum means, and said synchronizing pulse corresponds to each of the positions of said type on said rotatable drum means.

42. The type printer of claim 1, further including ink roller means for alternately applying within the same row of type at least two colors of ink to said type.

43. The type printer of claim 2, wherein said type if at predetermined positions on said rotatable drum means, and said synchronizing pulse corresponds to each of the positions of said type on said rotatable drum means.

44. The type printer of claim 2, further including ink roller means for alternately applying within the same row of type at least two colors of ink to said type.

45. The type printer of claim 3, wherein said type is at predetermined positions on said rotatable drum means, and said synchronizing pulse corresponds to each of the positions of said type on said rotatable drum means.

46. The type printer of claim 3, further including ink roller means for alternately applying within the same row of type at least two colors of ink to said type.

47. The type printer of claim 4, wherein said type is at predetermined positions on said rotatable drum means, and said synchronizing pulse corresponds to each of the positions of said type on said rotatable drum means.

48. The type printer of claim 4, further including ink roller means for alternately applying within the same row of type at least two colors of ink to said type.

49. The type printer of claim 5, wherein said type is at predetermined positions on said rotatable drum means, and said synchronizing pulse corresponds to each of the positions of said type on said rotatable drum means.

50. The type printer of claim 5, further including ink roller means for alternately applying within the same row of type at least two colors of ink to said type.

51. The type printer of claim 11, wherein said type is at predetermined positions on said rotatable drum means, and said synchronizing pulse corresponds to each of the positions of said type on said rotatable drum means.

52. The type printer of claim 11, further including ink roller means for alternately applying within the same row of type at least two colors of ink to said type.

53. The type printer of claim 16, wherein said type is at predetermined positions on said rotatable drum means, and said synchronizing pulse corresponding to each of the positions of said type on said rotatable drum means.

54. The type printer of claim 16, further including ink roller means for alternately applying within the same row of type at least two colors of ink to said type.

55. The type printer of claim 29, wherein said type is at predetermined positions on said rotatable drum means, and said synchronizing pulse corresponds to each of the positions of said type on said rotatable drum means.

56. The type printer of claim 29, further including ink roller means for alternately applying within the same row of type at least two colors of ink to said type.

57. The type printer of claim 55, wherein said trigger means initiates operation of said disabling control means in response to said synchronizing pulse.

58. The type printer of claim 56, wherein said trigger means initiates operation of said disabling control means in response to said synchronizing pulse.

59. The type printer of claim 1, further including damper means for suppressing vibration of said type means created by said driving force being applied to or removed from said rotatable type drum means.

60. The type printer of claim 1, further including a print electromagnet and hammer means housed within said rotatable type drum means, said hammer means driven by said print electromagnet for striking said type from inside said rotatable type drum means.

61. The type printer of claim 2, further including damper means for suppressing vibration of said type means created by said driving force being applied to or removed from said rotatable type drum means.

62. The type printer of claim 2, further including a print electromagnet and hammer means housed within said rotatable type drum means, said hammer means driven by said print electromagnet for striking said type from inside said rotatable type drum means.

63. The type printer of claim 3, further including damper means for suppressing vibration of said type means created by said driving force being applied to or removed from said rotatable type drum means.

64. The type printer of claim 3, further including a print electromagnet and hammer means housed within said rotatable type drum means, said hammer means driven by said print electromagnet for striking said type from inside said rotatable type drum means.

65. The type printer of claim 4, further including damper means for suppressing vibration of said type means created by said driving force being applied to or removed from said rotatable type drum means.

66. The type printer of claim 4, further including a print electromagnet and hammer means housed within said rotatable type drum means, said hammer means driven by said print electromagnet for striking said type from inside said rotatable type drum means.

67. The type printer of claim 5, further including damper means for suppressing vibration of said type means created by said driving force being applied to or removed from said rotatable type drum means.

68. The type printer of claim 5, further including a print electromagnet and hammer means housed within said rotatable type drum means, said hammer means driven by said print electromagnet for striking said type from inside said rotatable type drum means.

69. The type printer of claim 59, wherein said damper means includes a damper wheel for slidably selectively cooperating with said type drum means.

70. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning of said predetermined operating position to remove application of said driving force to said rotatable type drum means, said disabling means including means for rendering said disabling means inoperable until said two revolutions have been completed;

shifting means for moving said rotatable type drum means in reciprocating linear direction in response to said driving force; and a frame and a projection protruding from said frame, said rotatable type drum means including a pair of grooves encircling said rotatable type drum means and crossing over one another, said projection being positioned within one of said grooves, said projection and grooves serving as said shifting means wherein said rotatable type drum means upon application of said driving force by said driving means moves in one of two reciprocating directions based on the position of said projection within said groove.

71. The type printer of claim 70, wherein said type is at predetermined positions on said rotatable drum means and further including detecting means for generating a synchronizing pulse corresponding to each of the positions of said type on said rotatable drum means.

72. The type printer of claim 70, further including ink roller means for alternately applying within the same row of type at least two colors of ink to said type.

73. A type printer, comprising:

a rotatable type drum means for providing type; said rotatable type drum having a predetermined operating position prior to initial rotation thereof;

driving means for applying a driving force to said rotatable type drum means to rotate said rotatable type drum means;

driving control means for controlling said driving means and including a selection lever and cam means, said selection lever coupled indirectly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed, said disabling means being operable for disabling said driving means when said rotatable type drum means is at said predetermined operating position;

shifting means for moving said rotatable type drum means in reciprocating linear directions in response to said driving force; and a frame and a projection protruding from said frame, said rotatable type drum means including a pair of grooves encircling said rotatable type drum means and crossing over one another, said projection being positioned within one of said grooves, said projection and grooves serving as said shifting means wherein said rotatable type drum means upon application of said driving force by said driving means moves in one of two reciprocating directions based on the position of said projection within said groove.

74. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means;

shifting means for moving said rotatable type drum means in reciprocating linear direction in response to said driving force; and a frame and a projection protruding from said frame, said rotatable type drum means including a pair of grooves encircling said rotatable type drum means and crossing over one another, said projection being positioned within one of said grooves, said projection and grooves serving as said shifting means wherein said rotatable type drum means upon application of said driving force by said driving means moves on one of two reciprocating directions based on the position of said projection within said grooves.

75. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means, said disabling control means serving as said driving control means;

shifting means for moving said rotatable type drum means in reciprocating linear directions in response to said driving force; and a frame and a projection protruding from said frame, said rotatable type drum means including a pair of grooves encircling said rotatable type drum means and crossing over one another, said projection being positioned within one of said grooves, said projection and grooves serving as said shifting means wherein said rotatable type drum means upon application of said driving force by said driving means moves in one of two reciprocating directions based on the position of said projection within said grooves.

76. The type printer of claim 75, wherein said driving control means further includes a sun-and-planet gear mechanism and a gear having teeth facing radially inwardly, said selecting lever coupled to said sun-and-planet gear mechanism and cam means.

77. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means, said disabling control means serving as said driving control means;

trigger means for initiating operation of said disabling control means and said driving control means;

shifting means for moving said rotatable type drum means in reciprocating linear directions in response to said driving force; and a frame and a projection protruding from said frame, said rotatable type drum means including a pair of grooves encircling said rotatable type drum means and crossing one another, said projection being positioned within one of said grooves, said projection and grooves serving as said shifting means wherein said rotatable type drum means upon application of said driving force by said driving means moves in one of two reciprocating directions based on the position of said projection within said grooves.

78. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed, said driving means including a notched gear having a notch and a plurality of teeth except within said notch and said disabling means including tooth means having one or more teeth for insertion into or removal from said notch;

disabling control means for controlling said disabling means;

shifting means for moving said rotatable type drum means in reciprocating linear directions in response to said driving force; and a frame and a projection protruding from said frame, said rotatable type drum means including a pair of grooves encircling said rotatable type drum means and crossing over one another, said projection being positioned within one of said grooves, said projection and grooves serving as said shifting means wherein said rotatable type drum means upon application of said driving force by said driving means moves in one of two reciprocating directions based on the position of said projection within said grooves.

79. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means, said disabling control means serving as said driving control means, said driving means including a notched gear having a notch and a plurality of teeth except within said notch said disabling means including tooth means having one or more teeth for insertion into or removal from said notch;

shifting means for moving said rotatable type drum means in reciprocating linear directions in response to said driving force; and a frame and a projection protruding from said frame, said rotatable type drum means including a pair of grooves encircling said rotatable type drum means and crossing over one another, said projection positioned within one of said grooves, said projection and grooves serving as said shifting means wherein said rotatable type drum means upon application of said driving force by said driving means moves in one of two reciprocating direction based on the position of said projection within said grooves.

80. The type printer of claim 79, wherein said driving control means includes a sun-and-planet gear mechanism and a gear having teeth facing radially inwardly, said selecting lever coupled to said sun-and-planet gear mechanism and cam means.

81. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means, said disabling control means serving as said driving control means, said driving means including a notched gear having a notch and a plurality of teeth except within said notch said disabling means including tooth means having one or more teeth for insertion into or removal from said notch;

trigger means for initiating operation of said disabling control means and said driving control means;

shifting means for moving said rotatable type drum means in reciprocating linear directions in response to said driving force; and a frame and a projection protruding from said frame, said rotatable type drum means including a pair of grooves encircling said rotatable type drum means and crossing over one another, said projection positioned within one of said grooves, said projection and grooves serving as said shifting means wherein said rotatable type drum means upon application of said driving force by said driving means moves in one of two reciprocating direction based on the position of said projection within said grooves.

82. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed; and damper means for suppressing vibration of said type means created by said driving force being applied to or removed from said rotatable drum means, said damper means including an inertia wheel and a spring pressure welded to said inertia wheel.

83. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed, said disabling means being operable for disabling said driving means when said rotatable type drum means is at said predetermined operating position; and damper means for suppressing vibration of said type means created by said driving force being applied to or removed from said rotatable type drum means, said damper means including an inertia wheel and a spring pressure welded to said inertia wheel.

84. A type printer, comprising:

rotatable type drum means for providing type; means rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means; and damper means for suppressing vibration of said type means created by said driving force being applied to or removed from said rotatable type drum means, said damper means including an inertia wheel and a spring pressure welded to said inertia wheel.

85. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means, said disabling control means serving as said driving control means;

damper means for suppressing vibration of said type means created by said driving force being applied to or removed from said rotatable type drum means, said damper means including an inertia wheel and a spring pressure welded to said inertia wheel.

86. A type printer, comprising:

rotatable type drum means for providing type; said rotatable type drum means having a predetermined operating position prior to initial rotation thereof;

driving means for applying a driving force to said rotatable type drum means to rotate said rotatable type drum means;

driving control means for controlling said driving means and including a selection lever and cam means, said selection lever coupled directly to and for controlling the position of said cam means, the position of said cam means determining the control applied by said driving control means to said driving means to control the application of the driving force to the type drum means;

disabling means for disabling said driving means following two complete revolutions of said rotatable type drum means beginning at said predetermined operating position to remove application of said driving force to said rotatable type drum means, said disabling means including means for rendering said disabling means inoperable until said two revolutions have been completed;

disabling control means for controlling said disabling means, said disabling control means serving as said driving control means;

trigger means for initiating operation of said disabling control means and said driving control means; and damper means for suppressing vibration of said type means created by said driving force being applied to or removed from said rotatable type drum means, said damper means including an inertia wheel and a spring pressure welded to said inertia wheel.

87. A type printer, comprising:

type means having type arranged in a predetermined pattern, said type means rotatable in response to a driving force applied thereto;

selection means for selectively controlling application of said driving force to said type means;

driving means for applying said driving force to said type means and responsive to said selection means, said driving means including a motor;

detection means for generation of timing pulses in response to rotation of said motor;

a print electromagnet for generating a magnetic field and energized in synchronism with said timing pulses when said driving force is not being applied to said type means; and hammer means responsive to said magnetic field of said print electromagnet for striking said type when said driving force is not being applied to said type means.

88. The type printer of claim 87, wherein said timing pulses correspond to the position of said type during rotation of said type means.

89. The type printer of claim 88, further including damper means for suppressing vibration of said type means created by said driving force being applied to or removed from said type means.

90. A type printer, comprising:

type means having type arranged in a predetermined pattern, said type means rotatable in response to a driving force applied thereto;

selection means for selectively controlling application of said driving force to said type means;

driving means for applying said driving force to said type means and responsive to said selection means, said driving means including a motor;

detection means for generation of timing pulses in response to rotation of said motor, said timing pulses also corresponding to the position of said type during rotation of said type means;

a print electromagnet for generating a magnetic field and energized in synchronism with said timing pulses;

hammer means responsive to said magnetic field of said print electromagnet for striking said type; and damper means for suppressing vibration of said type means created by said driving force being applied to or removed from said type means, said damper means including an inertia wheel and a spring pressure welded to said inertia wheel.

91. A type printer, comprising:

a rotatable type drum having an exterior surface with type arranged on the exterior surface;

a rotatable drum gear having the same axis of rotation as, coupled to and which rotates in unison with said rotatable type drum;

motor means for generating a driving force, said rotatable drum gear rotating in response to application of said driving force;

detection means for detecting rotation of said motor and outputting a synchronization pulse in response thereto;

driving control means for controlling application of said driving force applied to said rotatable drum gear in response to said synchronization pulse and including a selection lever and cam means, said selection lever coupled directly to and for controlling the position of said cam means, said position of said cam means determining the amount of driving force to be applied to said rotatable drum gear to control the application of the driving force to the rotatable drum gear;

a print electromagnet housed within said rotatable type drum;

hammer means driven by said print electromagnet for striking said type from inside said rotatable type drum when said electromagnet is energized, said electromagnet being energized in response to said synchronization pulse; and selection means for selectively controlling transmission of said driving force to said rotatable drum gear.

92. The type printer of claim 91, wherein said rotatable type drum and rotatable drum gear each have a housing, said motor means including a motor in the shape of a cylinder having flattened sides and disposed within the housing of one of said rotatable type drum and rotatable drum gear, said motor being disposed so as to create a space between itself and said housing, said print electromagnet having a yoke with one end of said yoke extending through and beyond said space.

* * * * *